US008846281B2

(12) United States Patent
Okuda et al.

(10) Patent No.: US 8,846,281 B2
(45) **Date of Patent: *Sep. 30, 2014**

(54) ELECTROPHOTOGRAPHIC PHOTOSENSITIVE MEMBER, PROCESS CARTRIDGE, AND ELECTROPHOTOGRAPHIC APPARATUS

(75) Inventors: Atsushi Okuda, Yokohama (JP); Hirotoshi Uesugi, Numazu (JP); Kazunori Noguchi, Suntou-gun (JP); Tsutomu Nishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 521 days.

This patent is subject to a terminal disclaimer.

(21) Appl. No.: 13/059,629

(22) PCT Filed: Sep. 24, 2009

(86) PCT No.: PCT/JP2009/067121

§ 371 (c)(1), (2), (4) Date: Feb. 17, 2011

(87) PCT Pub. No.: WO2010/035882

PCT Pub. Date: Apr. 1, 2010

(65) Prior Publication Data

US 2011/0158683 A1 Jun. 30, 2011

(30) Foreign Application Priority Data

Sep. 26, 2008 (JP) ..... 2008-248210

(51) Int. Cl.

| | |
|---|---|
| ***G03G 15/00*** | (2006.01) |
| ***G03G 5/04*** | (2006.01) |
| ***G03G 5/147*** | (2006.01) |
| ***G03G 5/05*** | (2006.01) |
| ***G03G 21/00*** | (2006.01) |

(52) U.S. Cl.

CPC ..... *G03G 5/0578* (2013.01); *G03G 5/14756* (2013.01); *G03G 5/0564* (2013.01); *G03G 5/14773* (2013.01); *G03G 21/0011* (2013.01); *G03G 15/751* (2013.01)

USPC ..... 430/66; 430/56; 430/58.2; 430/96; 399/159

(58) Field of Classification Search

CPC ..... G03G 5/14773; G03G 21/0011; G03G 5/0578; G03G 5/0564; G03G 15/751; G03G 5/14756

USPC ..... 430/66, 56, 58.2, 96; 399/159

See application file for complete search history.

(56) References Cited

U.S. PATENT DOCUMENTS 6,185,398 B1 2/2001 Tanaka et al.
6,444,384 B2 9/2002 Kawamorita et al.

(Continued)

FOREIGN PATENT DOCUMENTS

EP 1 324 141 A1 7/2003
JP 2-272557 A 11/1990

(Continued)

OTHER PUBLICATIONS

PCT International Search Report and Written Opinion of the International Searching Authority, International Application No. PCT/JP2009/067121, Mailing Date Oct. 27, 2009.

(Continued)

*Primary Examiner* — Christopher Rodee
*Assistant Examiner* — Omar Kekia
(74) *Attorney, Agent, or Firm* — Fitzpatrick, Cella, Harper and Scinto

(57) ABSTRACT

An electrophotographic photosensitive member having a surface layer which contains a silicon-containing compound in an amount of less than 0.6% by mass based on the whole solid content in the surface layer, where the silicon-containing compound in the surface layer has a siloxane moiety in an amount of 0.01% by mass or more, based on the whole solid content in the surface layer, and its surface has specific depressions. Also disclosed are a process cartridge and an electrophotographic apparatus which have the electrophotographic photosensitive member.

9 Claims, 7 Drawing Sheets

(56) References Cited

U.S. PATENT DOCUMENTS

| | | | | |
|---|---|---|---|---|
| 6,939,651 | B2 | 9/2005 | Li et al. | |
| 6,942,952 | B2 | 9/2005 | Uesugi et al. | |
| 7,171,142 | B2 | 1/2007 | Kawakami et al. | |
| 7,226,711 | B2 | 6/2007 | Amamiya et al. | |
| 7,553,594 | B2 | 6/2009 | Ogaki et al. | |
| 7,556,901 | B2 | 7/2009 | Anezaki et al. | |
| 7,629,102 | B2 | 12/2009 | Ochi et al. | |
| 7,645,547 | B2 * | 1/2010 | Okuda et al. | 430/56 |
| 7,655,370 | B2 | 2/2010 | Kitamura et al. | |
| 7,704,657 | B2 | 4/2010 | Uesugi et al. | |
| 7,732,113 | B2 | 6/2010 | Nakamura et al. | |
| 7,749,667 | B2 | 7/2010 | Kawahara et al. | |
| 7,799,496 | B2 | 9/2010 | Uesugi et al. | |
| 7,838,190 | B2 | 11/2010 | Ogaki et al. | |
| 2006/0099016 | A1 * | 5/2006 | Watanabe et al. | 399/351 |
| 2008/0019735 | A1 | 1/2008 | Ogaki et al. | |
| 2008/0124637 | A1 | 5/2008 | Uematsu et al. | |
| 2009/0029277 | A1 * | 1/2009 | Okuda et al. | 430/96 |

FOREIGN PATENT DOCUMENTS

| | | | |
|---|---|---|---|
| JP | 10-142813 | A | 5/1998 |
| JP | 2000-75517 | A | 3/2000 |
| JP | 2001-66814 | A | 3/2001 |
| JP | 2003-202686 | A | 7/2003 |
| JP | 2005-338586 | A | 12/2005 |
| JP | 2007-199688 | A | 8/2007 |
| JP | 2007-233357 | A | 9/2007 |
| JP | 2007-233359 | A | 9/2007 |
| WO | 2005/093518 | A1 | 10/2005 |

OTHER PUBLICATIONS

Noguchi, et al., U.S. Appl. No. 13/007,439, filed Jan. 14, 2011.
European Search Report dated Jul. 22, 2014 in European Application No. 09816294.4.

* cited by examiner

ELECTROPHOTOGRAPHIC PHOTOSENSITIVE MEMBER, PROCESS CARTRIDGE, AND ELECTROPHOTOGRAPHIC APPARATUS

TECHNICAL FIELD

This invention relates to an electrophotographic photosensitive member, and a process cartridge and an electrophotographic apparatus which have the electrophotographic photosensitive member.

BACKGROUND ART

The electrophotographic photosensitive member is commonly used in an electrophotographic image forming process having a charging step, an exposure step, a developing step, a transfer step and a cleaning step. Of the electrophotographic image forming process, the cleaning step, in which a toner remaining on the electrophotographic photosensitive member after the transfer step, what is called transfer residual toner, is removed to clean the surface of the electrophotographic photosensitive member, is an important step in order to obtain sharp images. A cleaning method making use of a cleaning blade is a cleaning method operated by bringing the cleaning blade and the electrophotographic photosensitive member into friction with each other. Also, in recent years, in the charging step, a method has come prevalent in which the electrophotographic photosensitive member is directly charged by means of a charging roller. Thus, a phenomenon called "rubbing memory" may be given as one of important problems in such make-up that the charging roller and the cleaning blade come into contact or touch with the electrophotographic photosensitive member. This phenomenon is one of memory phenomena which is caused when the charging roller or cleaning blade kept in contact or touch with the electrophotographic photosensitive member and the electrophotographic photosensitive member have undergone any impact due to the vibration or fall that may come during physical distribution and they come rubbed together to generate positive electric charges on the surface of the electrophotographic photosensitive member.

A surface layer of the electrophotographic photosensitive member is commonly often formed by dip coating. The surface of such a surface layer formed by dip coating, i.e., the surface of the electrophotographic photosensitive member has a tendency to be smooth. Hence, this makes the area of contact (or touch) larger between the cleaning blade or charging roller and the surface of the electrophotographic photosensitive member to make frictional resistance larger between the cleaning blade or charging roller and the surface of the electrophotographic photosensitive member, so that there tends to be seen the above problem seriously.

In addition, in recent years, in order to improve image quality, toner particles are being made smaller in diameter. The smaller in diameter the toner particles are being made, the larger the area of contact is between the toner and the electrophotographic photosensitive member. This makes the toner adhere to the surface of the electrophotographic photosensitive member at a large force per unit mass, and hence the surface of the electrophotographic photosensitive member may come low cleanable. Accordingly, it is necessary to set the cleaning blade at a high touch pressure so as to keep the toner from slipping through. Since, however, the surface of the electrophotographic photosensitive member is smooth as stated above, it comes into highly close touch with the cleaning blade. Thus, they stand in such a set-up that any faulty images due to the rubbing memory more tend to occur. In particular, where any vibration is applied to, e.g., a process cartridge, the friction is greatly produced between the cleaning blade and the electrophotographic photosensitive member, and hence this problem is serious.

As a way of overcoming the problems attendant on the friction between these cleaning blade and charging roller and the electrophotographic photosensitive member, a technique is available which is disclosed in Japanese Patent Laid-open Application No. H10-142813. This Japanese Patent Laid-open Application No. H10-142813 discloses a technique in which phenyl groups substituted with fluorine are introduced at terminals of binder molecules so as to lessen the friction with the cleaning blade. Japanese Patent Laid-open Application No. 2000-75517 also discloses a technique in which a charge transporting material with a specific structure and a polycarbonate with a specific structure are combined to keep any memory from occurring.

From the viewpoint of less friction between the electrophotographic photosensitive member and the charging roller or cleaning blade, it is considered to be one means to make the electrophotographic photosensitive member change in surface profile. For example, Japanese Patent Application Laid-open No. 2001-066814 discloses a technique in which a stamper (stamping die) having a well-shaped unevenness is used to process the surface of the electrophotographic photosensitive member by compression forming.

However, even where the electrophotographic photosensitive members disclosed in Japanese Patent Laid-open Applications No. H10-142813 and No. 2000-75517 are used, the memory caused by their friction with members coming into contact or touch with the electrophotographic photosensitive member may come about under severer conditions as in a vibration test, and it is sought to make further improvement.

Where the finely surface-processed electrophotographic photosensitive member disclosed in Japanese Patent Application Laid-open No. 2001-066814 is used and it is an electrophotographic photosensitive member with shallow wells in its uneven surface profile, it is unable to sufficiently reduce the area of contact (or touch) between the surface of the electrophotographic photosensitive member and the charging roller or cleaning blade that is an elastic member. Hence, the effect of keeping the rubbing memory from occurring can not well be obtained in some cases.

DISCLOSURE OF THE INVENTION

The present invention has been made taking account of the above problems the conventional electrophotographic photosensitive members have had. Accordingly, an object of the present invention is to provide an electrophotographic photosensitive member having made any rubbing memory kept from occurring even where the electrophotographic photosensitive member and the members coming into contact or touch with the electrophotographic photosensitive member stand in highly close contact or touch with each other, and a process cartridge and an electrophotographic apparatus which have such an electrophotographic photosensitive member.

The present invention is an electrophotographic photosensitive member having a support and a photosensitive layer provided on the support, wherein;

a surface layer of the electrophotographic photosensitive member contains a silicon-containing compound in an amount of less than 0.6% by mass based on the whole solid content in the surface layer;

the silicon-containing compound in the surface layer has a siloxane moiety in an amount of 0.01% by mass or more, based on the whole solid content in the surface layer;

on the surface of the electrophotographic photosensitive member, depressions (depressed portions) which are independent from one another are formed in a number of from 50 or more to 70,000 or less per unit area (100

μm×100 μm), and the depressions are depressions each having a ratio of depth (Rdv) to major-axis diameter (Rpc), Rdv/Rpc, of from more than 0.3 to 7.0 or less and having a depth (Rdv) of from 0.1 μm or more to 10.0 μm or less;

the surface layer has, at the outermost surface thereof, a silicon element in a presence proportion of 0.6% by mass or more, based on constituent elements thereat, as measured by X-ray photoelectron spectroscopy (ESCA); and the presence proportion [A (% by mass)] of the silicon element to the constituent elements in the surface layer at an inner part of 0.2 μm from the outermost surface thereof and the presence proportion [B (% by mass)] of the silicon element to the constituent elements at the outermost surface thereof as measured by X-ray photoelectron spectroscopy (ESCA) are in a ratio (A/B) of from more than 0.0 to less than 0.3; and the silicon-containing compound is a polymer having a structure represented by the following Formula (1) and a repeating structural unit represented by the following Formula (2) or the following Formula (3):

(1)

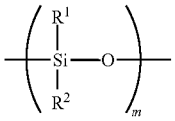

wherein $R^1$ and $R^2$ each independently represent a hydrogen atom, a halogen atom, an alkoxyl group, a nitro group, a substituted or unsubstituted alkyl group or a substituted or unsubstituted aryl group; and m represents an average value of the number of repeating structural units each shown in parentheses, and is in the range of from 1 to 500; and (2)

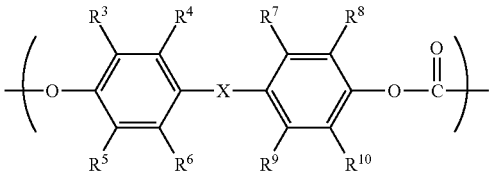

wherein X represents a single bond, —O—, —S— or a substituted or unsubstituted alkylidene group; and $R^3$ to $R^{10}$ each independently represent a hydrogen atom, a halogen atom, an alkoxyl group, a nitro group, a substituted or unsubstituted alkyl group or a substituted or unsubstituted aryl group; or (3)

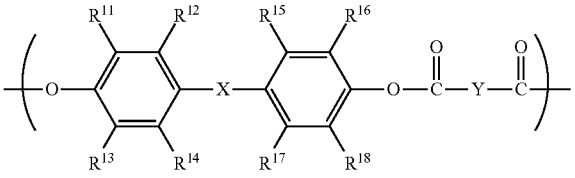

wherein X and Y each represent a single bond, —O—, —S— or a substituted or unsubstituted alkylidene group; and $R^{11}$ to $R^{18}$ each independently represent a hydrogen atom, a halogen atom, an alkoxyl group, a nitro group, a substituted or unsubstituted alkyl group or a substituted or unsubstituted aryl group.

The present invention is also a process cartridge which is a process cartridge having the above electrophotographic photosensitive member and supported integrally therewith a cleaning means, and being detachably mountable to the main body of an electrophotographic apparatus;

the cleaning means having a cleaning blade which is provided in touch with, and in the direction counter to, the surface of the electrophotographic photosensitive member.

The present invention is still also an electrophotographic apparatus having the above electrophotographic photosensitive member, a charging means, an exposure means, a developing means, a transfer means and a cleaning means;

the cleaning means having a cleaning blade which is provided in touch with, and in the direction counter to, the surface of the electrophotographic photosensitive member.

According to the present invention, it can provide an electrophotographic photosensitive member having made any rubbing memory kept from occurring, and a process cartridge and an electrophotographic apparatus which have such an electrophotographic photosensitive member.

BEST MODE FOR PRACTICING THE INVENTION

Figure 1A:
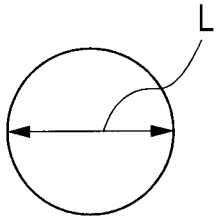
FIGS. 1A, 1B, 1C, 1D, 1E, 1F and 1G are views showing examples of the shape of a depression (top view) at the surface of the electrophotographic photosensitive member of the present invention.
Figure 1E:
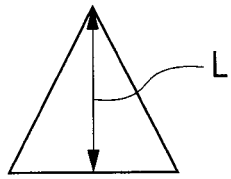
Figure 1B:
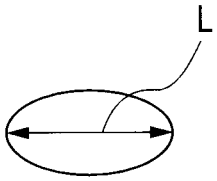
Figure 1F:
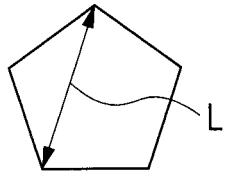
Figure 1C:
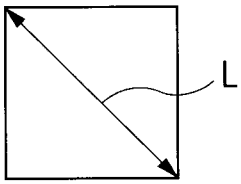
Figure 1G:
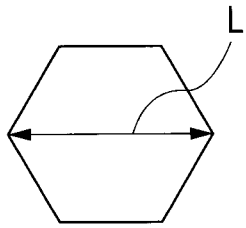
Figure 1D:
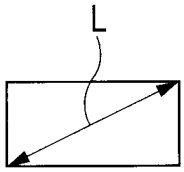
Figure 2A:
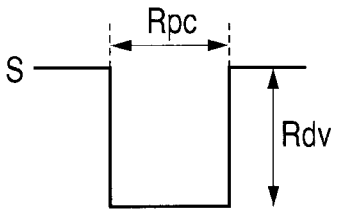
FIGS. 2A, 2B, 2C, 2D, 2E, 2F and 2G are views showing examples of the shape of a depression (cross section) at the surface of the electrophotographic photosensitive member of the present invention.
Figure 2B:
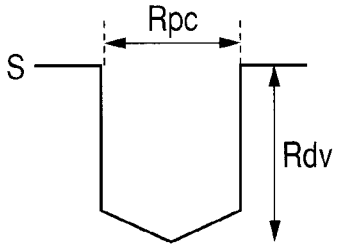
Figure 2C:
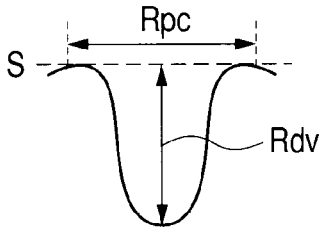
Figure 2D:
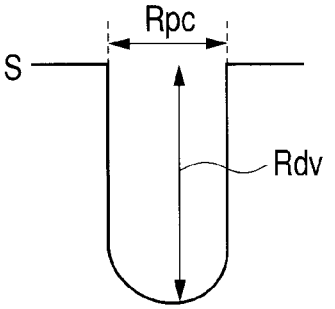
Figure 2E:
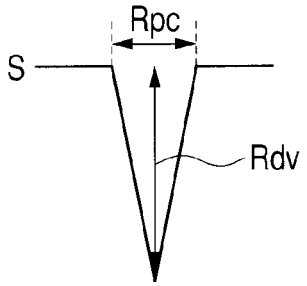
Figure 2F:
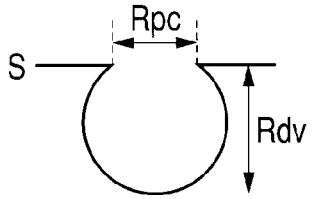
Figure 2G:
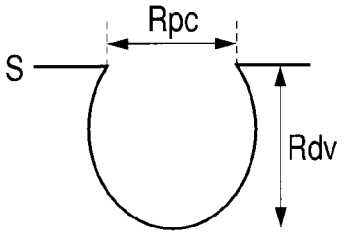

The present inventors have discovered that the problems discussed above can be resolved by incorporating into the surface layer of the electrophotographic photosensitive member a silicon-containing compound having specific structure and also making the surface of the electrophotographic photosensitive member have specific depressions, thus they have accomplished the present invention.

The electrophotographic photosensitive member of the present invention is, as summarized above, an electrophotographic photosensitive member having a support and a photosensitive layer provided on the support. Also, a surface layer of the electrophotographic photosensitive member of the present invention contains the silicon-containing compound in an amount of less than 0.6% by mass based on the whole solid content in the surface layer, and the silicon-containing compound in the surface layer has a siloxane moiety in an amount of 0.01% by mass or more, based on the whole solid content in the surface layer. Still also, the surface of the electrophotographic photosensitive member satisfies all the following requirements (a), (b) and (c):

(a) on the surface of the electrophotographic photosensitive member, depressions which are independent from one another are formed in a number of from 50 or more to 70,000 or less per unit area (100 μm×100 μm), and also the depressions are depressions each have a ratio of depth (Rdv) to major-axis diameter (Rpc), Rdv/Rpc, of from more than 0.3 to 7.0 or less and have a depth (Rdv) of from 0.1 μm or more to 10.0 μm or less;

(b) the surface layer of the electrophotographic photosensitive member has, at the outermost surface thereof, a silicon element in a presence proportion of 0.6% by mass or more, based on constituent elements thereat, as measured by X-ray photoelectron spectroscopy (ESCA); and the presence proportion [A (% by mass)] of the silicon element to the constituent elements in the surface layer at an inner part of 0.2 μm from the outermost surface thereof and the presence proportion [B (% by mass)] of the silicon element to the constituent elements at the outermost surface thereof as measured by X-ray photoelectron spectroscopy (ESCA) are in a ratio (A/B) of from more than 0.0 to less than 0.3; and (c) the above silicon-containing compound is a polymer having a structure represented by the following Formula (1) and a repeating structural unit represented by the following Formula (2) or the following Formula (3). The polymer herein termed is a polycarbonate when it has the repeating structural unit represented by the following Formula (2), and is a polyester when it has the repeating structural unit represented by the following Formula (3).

(1)

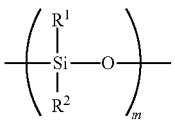

In Formula (1), $R^1$ and $R^2$ each independently represent a hydrogen atom, a halogen atom, an alkoxyl group, a nitro group, a substituted or unsubstituted alkyl group or a substituted or unsubstituted aryl group; and m represents an average value of the number of repeating structural units each shown in parentheses, and is in the range of from 1 to 500.

(2)

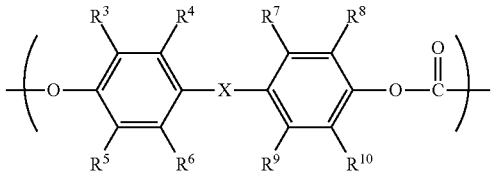

In Formula (2), X represents a single bond, —O—, —S— or a substituted or unsubstituted alkylidene group; and $R^3$ to $R^{10}$ each independently represent a hydrogen atom, a halogen atom, an alkoxyl group, a nitro group, a substituted or unsubstituted alkyl group or a substituted or unsubstituted aryl group.

(3)

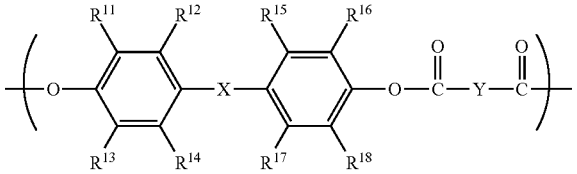

In Formula (3), X and Y each represent a single bond, —O—, —S— or a substituted or unsubstituted alkylidene group; and $R^{11}$ to $R^{18}$ each independently represent a hydrogen atom, a halogen atom, an alkoxyl group, a nitro group, a substituted or unsubstituted alkyl group or a substituted or unsubstituted aryl group.

The depressions formed on the surface of the electrophotographic photosensitive member of the present invention are described first.

In the present invention, the "depressions which are independent from one another" means depressions which are present in the state that individual depressions are clearly separated from other depressions.

In the present invention, the depressions to be formed on the surface of the electrophotographic photosensitive member in the present invention may include, e.g., in the observation of the surface of the electrophotographic photosensitive member, those having a shape in which they are each constituted of straight lines, those having a shape in which they are each constituted of curved lines, and those having a shape in which they are each constituted of straight lines and curved lines. The shape in which they are constituted of straight lines may include, e.g., triangles, quadrangles, pentagons and hexagons. The shape in which they are constituted of curved lines may include, e.g., circles and ellipses. The shape in which they are constituted of straight lines and curved lines may include, e.g., quadrangles with round corners, hexagons with round corners, and sectors.

In the present invention, the depressions to be formed on the surface of the electrophotographic photosensitive member in the present invention may also include, e.g., in the observation of the cross section of the photosensitive member, those having a shape in which they are each constituted of straight lines, those having a shape in which they are each constituted of curved lines, and those having a shape in which they are each constituted of straight lines and curved lines. The shape in which they are constituted of straight lines may include, e.g., triangles, quadrangles and pentagons. The shape in which they are constituted of curved lines may include, e.g., partial circles and partial ellipses. The shape in which they are constituted of straight lines and curved lines may include, e.g., quadrangles with round corners, and sectors.

As specific examples of the depressions to be formed on the surface of the electrophotographic photosensitive member, they may include depressions shown in FIGS. 1A to 1G (shape examples of depressions, in observation from the surface of the electrophotographic photosensitive member) and FIGS. 2A to 2G (shape examples of depressions, in observation of cross section). In the present invention, the depressions of the electrophotographic photosensitive member surface may individually have different shapes, sizes and depths. They may also all have the same shape, size and depth. The surface of the electrophotographic photosensitive member may further be a surface having in combination the depressions which individually have different shapes, sizes and depths and the depressions which have the same shape, size and depth.

The depressions are formed at least on the surface of the electrophotographic photosensitive member. Of the surface of the electrophotographic photosensitive member, the region where the depressions are formed may be the whole region of the surface of the electrophotographic photosensitive member, or may be formed at some part of the surface of the electrophotographic photosensitive member. In the case when the depressions are formed at some part of the surface of the electrophotographic photosensitive member, it is preferable for them to be formed in the range of an image forming region (the region exposable to light by a laser).

In the present invention, the major-axis diameter of the depressions corresponds to length L shown by an arrow in FIGS. 1A to 1G each and to the part shown by major-axis diameter Rpc in FIGS. 2A to 2G each. That is, the major-axis diameter in the present invention refers to the maximum length in a surface open-top shape of each depression, on the basis of the surface that surrounds openings or open-top spaces of the depressions in the electrophotographic photosensitive member. For example, where a depression has a surface open top shape of a circle, the major-axis diameter refers to the diameter. Where a depression has a surface open top shape of an ellipse, the major-axis diameter refers to the lengthwise diameter. Where a depression has a surface open top shape of a quadrangle, the major-axis diameter refers to the longer diagonal line among diagonal lines.

In the present invention, the depth of the depressions refers to the distance between the deepest part of each depression and the open top thereof. Stated specifically, as shown by depth Rdv in FIGS. 2A to 2G, it refers to the distance between the deepest part of each depression and the open top thereof, on the basis of the surface S that surrounds open-top spaces of the depressions of the surface in the electrophotographic photosensitive member.

On the surface of the electrophotographic photosensitive member of the present invention, depressions which are independent from one another are formed in a number of from 50 or more to 70,000 or less per unit area (100 μm×100 μm). The depressions herein termed refer to depressions each having a ratio of depth (Rdv) to major-axis diameter (Rpc), Rdv/Rpc, of from more than 0.3 to 7.0 or less and having a depth (Rdv) of from 0.1 μm or more to 10.0 μm or less. Any depressions having a depth (Rdv) of less than 0.1 μm or depressions having a ratio (Rdv/Rpc) of 0.3 or less can not promise any sufficient effect of preventing rubbing memory. On the other hand, depressions having too large depth (Rdv) or depressions having too large ratio (Rdv/Rpc) have a possibility of bringing about poor image characteristics due to any local discharge which may cause electrification deterioration of the surface layer of the electrophotographic photosensitive member, or may make it necessary to form the surface layer in a sufficiently large thickness. Hence, as to depressions having a depth (Rdv) of more than 10.0 μm or depressions having a ratio (Rdv/Rpc) of more than 7.0, it is preferable for them to be in a small number, and much preferable for them to be none at all.

That is, forming the above specific depressions in a large number on the surface of the electrophotographic photosensitive member of the present invention brings the effect of preventing rubbing memory.

On the surface of the electrophotographic photosensitive member of the present invention, the above specific depressions may be of any arrangement. Stated in detail, the specific depressions may be arranged at random, or may be arranged with regularity. In order to prevent the rubbing memory over the whole image areas, it is preferable for the depressions to be arranged with regularity.

In the present invention, the depressions formed on the surface of the electrophotographic photosensitive member may be observed on a commercially available laser microscope, optical microscope, electron microscope or atomic force microscope.

As the laser microscope, the following equipment may be used, for example:

An ultradepth profile measuring microscope VK-8550, an ultradepth profile measuring microscope VK-9000 and an ultradepth profile measuring microscope VK-9500 (all manufactured by Keyence Corporation); a surface profile measuring system SURFACE EXPLORER SX-520DR model instrument (manufactured by Ryoka Systems Inc.); a scanning conforcal laser microscope OLS3000 (manufactured by Olympus Corporation); and a real-color conforcal microscope OPTELICS C130 (manufactured by Lasertec Corporation).

As the optical microscope, the following equipment may be used, for example:

A digital microscope VHX-500 and a digital microscope VHX-2000 (both manufactured by Keyence Corporation), and a 3D digital microscope VC-7700 (manufactured by Omron Corporation).

As the electron microscope, the following equipment may be used, for example:

A 3D real surface view microscope VE-9800 and a 3D real surface view microscope VE-8800 (both manufactured by Keyence Corporation), a scanning electron microscope Conventional/Variable Pressure System SEM (manufactured by SII Nano Technology Inc.), and a scanning electron microscope SUPER SCAN SS-550 (manufactured by Shimadzu Corporation).

As the atomic force microscope, the following equipment may be used, for example:

A nanoscale hybrid microscope VN-8000 (manufactured by Keyence Corporation), a scanning probe microscope NanoNavi Station (manufactured by SII Nano Technology Inc.), and a scanning probe microscope SPM-9600 (manufactured by Shimadzu Corporation).

Using the above microscope, the major-axis diameter and depth of depressions in the measurement visual field may be observed at stated magnifications to measure these. Further, the area percentage of open tops of depressions per unit area may be found by calculation.

Measurement with Surface Explorer SX-520DR model instrument, making use of an analytical program, is described as an example. A measuring object electrophotographic photosensitive member is placed on a work stand. The tilt is adjusted to bring the stand to a level, where three-dimensional profile data of the peripheral surface of the electrophotographic photosensitive member are entered in the analyzer in a wave mode. Here, the objective lens may be set at 50 magnifications under observation in a visual field of 100 μm×100 μm (10,000 $\mu m^2$).

Next, contour line data of the surface of the electrophotographic photosensitive member are displayed by using a particle analytical program set in the data analytical software.

Hole analytical parameters of depressions, such as the shape, major-axis diameter, depth and open top area of the depressions may each be optimized according to the depressions formed. For example, where depressions of about 10 μm in major-axis diameter are observed and measured, the upper limit of major-axis diameter may be set at 15 μm, the lower limit of major-axis diameter at 1 μm, the lower limit of depth at 0.1 μm and the lower limit of volume at 1 $\mu m^3$. Then, the number of depressions distinguishable as depressions on an analytical picture is counted, and the resultant value is regarded as the number of the depressions.

Under the same visual field and analytical conditions as the above, the total open-top space area of the depressions may be calculated from the total of open-top space area of respective depressions that is found by using the above particle analytical program. Then, using the total open-top space area thus calculated, the open-top space area percentage of depressions (hereinafter simply also "area percentage") may be calculated according to the following expression.

Open-top space area percentage of depressions=[(total open-top space area of depressions)/(total open-top space area of depressions+total area of depression non-formed areas)]×100 (%).

Incidentally, as to depressions of about 1 μm or less in major-axis diameter, these may be measured with the laser microscope and the optical microscope. However, where measurement precision should be more improved, it is desirable to use observation and measurement with the electron microscope in combination.

How to form the depressions of the surface of the electrophotographic photosensitive member according to the present invention is described next. As methods for forming surface profiles, there are no particular limitations as long as they are methods that can satisfy the above requirements concerned with the depressions. Examples of how to form the depressions of the surface of the electrophotographic photosensitive member are as given below.

That is, it may be a method of forming depressions on the surface of the electrophotographic photosensitive member by irradiation with a laser having as its output characteristics a pulse width of 100 ns (nanoseconds) or less. It may also be a method of forming depressions on the surface of the electrophotographic photosensitive member by bringing a profile-providing material having a stated surface profile into pressure contact with the surface of the electrophotographic photosensitive member to effect surface profile transfer. It may still also be a method of forming depressions on the surface of the electrophotographic photosensitive member by causing condensation to occur on the surface of the electrophotographic photosensitive member when its surface layer is formed.

The method of forming depressions on the surface of the electrophotographic photosensitive member by irradiation with a laser having as its output characteristics a pulse width of 100 ns (nanoseconds) or less is described first. As specific examples of the laser used in this method, it may include an excimer laser making use of a gas such as Arf, KrF, XeF or XeCl as a laser medium, and a femtosecond laser making use of titanium sapphire as a laser medium. Further, the laser light in the above laser irradiation may preferably have a wavelength of 1,000 nm or less.

The excimer laser is a laser from which the light is emitted through the following steps. First, a mixed gas of a rare gas such as Ar, Kr or Xe and a halogen gas such as F or Cl is provided with energy by, e.g., discharge, electron beams or X-rays to excite and combine the above elements. Thereafter, the energy comes down to the ground state to cause dissociation, during which the excimer laser light is emitted. The gas used in the excimer laser may include, e.g., Arf, KrF, XeCl and XeF. In particular, KrF or ArF is preferred.

Figure 3A:
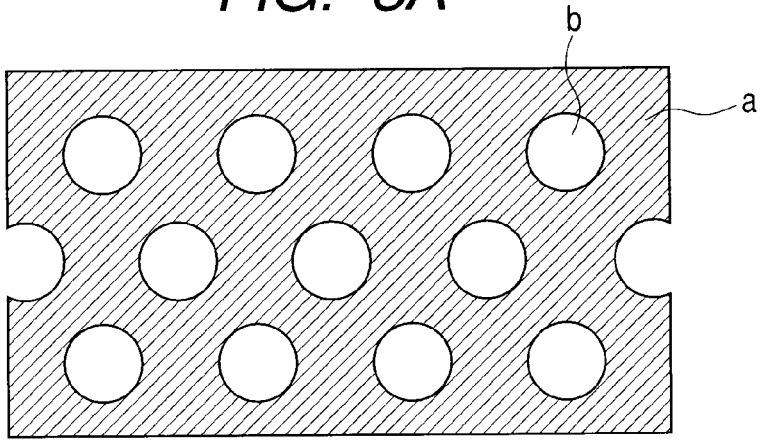
FIG. 3A is a view (partial enlarged view) showing an example of an arrangement pattern of a mask used in the present invention.
Figure 3B:
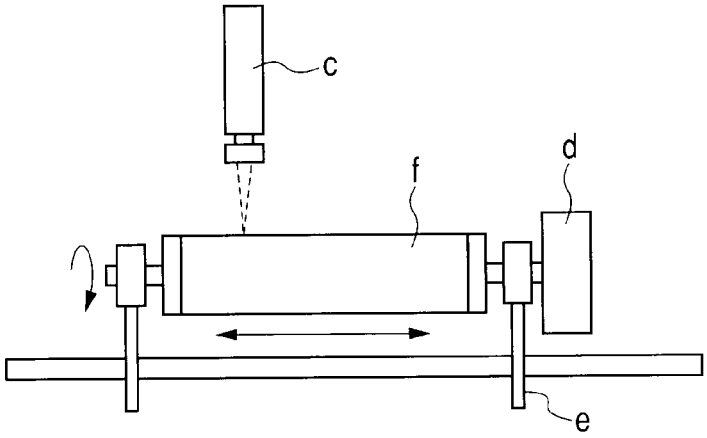
FIG. 3B is a schematic view showing an example of a laser surface processing unit used in the present invention.

As a method of forming the depressions, a mask as shown in FIG. 3A is used in which laser light shielding areas a and laser light transmitting areas b are appropriately arranged. Only the laser light having been transmitted through the mask is converged with a lens, and the surface of the electrophotographic photosensitive member is irradiated with that light. This enables formation of the depressions having the desired shape and arrangement. In the above method of forming depressions on the surface of the electrophotographic photosensitive member by laser irradiation, a large number of depressions in a certain area can instantly and simultaneously be formed without regard to the shape and area of the depressions. Hence, the step of forming the depressions can be carried out in a short time. By the laser irradiation making use of such a mask, the surface of the electrophotographic photosensitive member is processed in its region of from several $mm^2$ to several $cm^2$ per irradiation made once. In such laser processing, first, as shown in FIG. 3B, an electrophotographic photosensitive member f is rotated by means of a work rotating motor d. With its rotation, the laser irradiation position of an excimer laser light irradiator c is shifted in the axial direction of the electrophotographic photosensitive member f by means of a work movement unit e. This enables formation of the depressions in a good efficiency over the whole region of the surface of the electrophotographic photosensitive member.

The above method of forming depressions can produce the electrophotographic photosensitive member of the present invention. In the case when the depressions are formed on the surface of the electrophotographic photosensitive member by laser irradiation, the depth of depressions may be controlled by adjusting production conditions such as time and number of times of laser irradiation. From the viewpoint of precision in manufacture or productivity, in the case when the depressions are formed on the surface of the electrophotographic photosensitive member by laser irradiation, the depressions formed by irradiation made once may preferably be in a depth of from 0.1 μm or more to 2.0 μm or less. The employment of the above method of forming depressions enables materialization of surface processing of the electrophotographic photosensitive member in a high controllability for the size, shape and arrangement of the depressions, in a high precision and at a high degree of freedom.

Figure 3C:
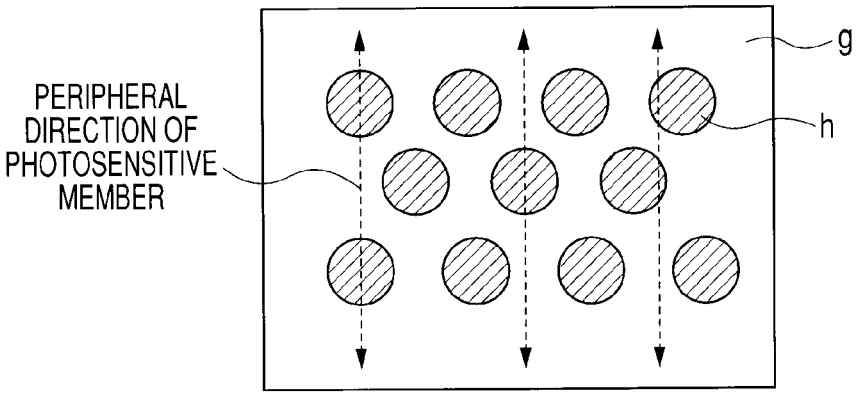
FIG. 3C is a view (partial enlarged view) showing an example of an arrangement pattern of depressions of the photosensitive member surface obtained according to the present invention.

In the method of forming depressions on the surface of the electrophotographic photosensitive member by laser irradiation, the above forming method may be applied to a plurality of surface portions or over the whole region of the photosensitive member surface by using like mask patterns. This method enables formation of depressions with a high uniformity over the whole surface of the electrophotographic photosensitive member. As the result, the mechanical load to be applied to the cleaning blade when the electrophotographic photosensitive member is used in an electrophotographic apparatus can be uniform. Also, as shown in FIG. 3C, the mask pattern may be so formed that both depressions h and depression non-formed areas g are so arranged as to be present on the lines (shown by arrows) of any peripheral directions of the electrophotographic photosensitive member surface. Their formation in this way enables more prevention of localization of the mechanical load to be applied to the cleaning blade and charging roller.

The method of forming depressions on the surface by bringing a profile-providing material having a stated surface profile, into pressure contact with the surface of the electrophotographic photosensitive member to effect surface profile transfer is described next.

Figure 4A:
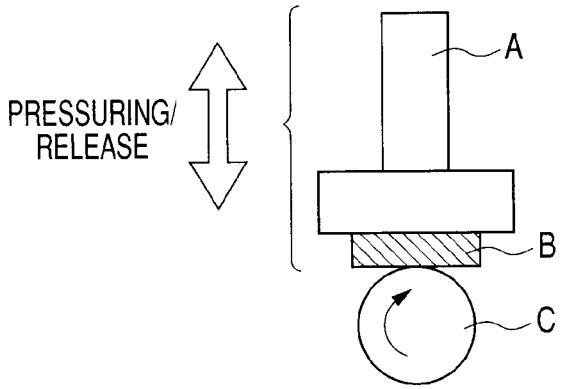
FIG. 4A is a schematic view showing an example of a pressure contact type profile transfer surface processing unit making use of a profile-providing material (mold) used in the present invention.

FIG. 4A is a schematic view showing an example of a pressure contact type profile transfer surface processing unit making use of the profile-providing material. A stated profile-providing material B is fitted to a pressuring unit A which can repeatedly perform pressuring and release, and thereafter the profile-providing material is brought into contact with an electrophotographic photosensitive member C at a stated pressure to effect transfer of a surface profile. Thereafter, the pressuring is first released to make the electrophotographic photosensitive member C rotated in the direction of an arrow, and then pressuring is again performed to carry out the step of transferring the surface profile. Repeating this step enables formation of stated depressions over the whole peripheral surface of the electrophotographic photosensitive member.

Figure 4B:
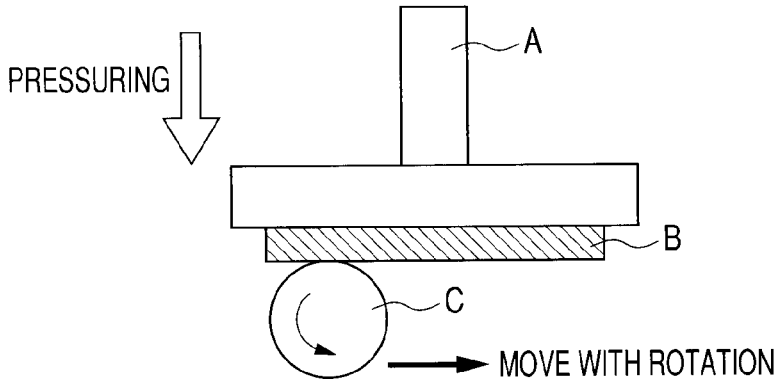
FIG. 4B is a view showing another example of a pressure contact type profile transfer surface processing unit making use of a profile-providing material (mold) used in the present invention.

Instead, as shown in FIG. 4B for example, a profile-providing material B having a stated surface profile covering substantially the whole peripheral length of the electrophotographic photosensitive member c may be fitted to the pressuring unit A, and thereafter, under application of a stated pressure to the electrophotographic photosensitive member C, the electrophotographic photosensitive member is rotated and moved in the directions shown by arrows. Thus, stated depressions are formed over the whole peripheral surface of the electrophotographic photosensitive member.

As another method, a sheet-like profile-providing material may be held between a roll-shaped pressuring unit and the electrophotographic photosensitive member to process the latter's surface while feeding the profile-providing material sheet.

For the purpose of effecting the surface profile transfer efficiently, the profile-providing material and the electrophotographic photosensitive member may be heated. The profile-providing material and the electrophotographic photosensitive member may be heated at any temperature as long as the depressions specified in the present invention can be formed. They may preferably be so heated as to have a temperature higher than the glass transition temperature (° C.) of the surface layer of the electrophotographic photosensitive member. Further, in addition to the heating of the profile-providing material, the temperature (° C.) of the support at the time of surface profile transfer may be so controlled as to be lower than the glass transition temperature (° C.) of the surface layer. This is preferable in order to stably form the depressions of the surface of the electrophotographic photosensitive member.

Where the surface layer of the electrophotographic photosensitive member is a charge transport layer, the profile-providing material and the electrophotographic photosensitive member may preferably be so heated that the temperature (° C.) of the profile-providing material at the time of surface profile transfer may be higher than the glass transition temperature (° C.) of the charge transport layer. Further, in addition to the heating of the profile-providing material, the temperature (° C.) of the support at the time of surface profile transfer may be kept controlled to be lower than the glass transition temperature (° C.) of the charge transport layer. This is preferable in order to stably form the depressions of the surface layer the electrophotographic photosensitive member.

Figure 5A:
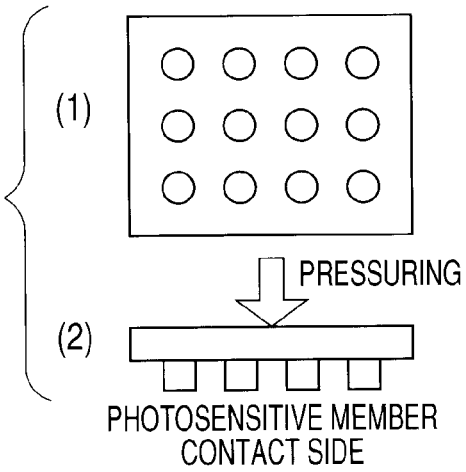
FIGS. 5A and 5B are each a partial enlarged view of the profile-providing material (mold) at its part coming into contact with the electrophotographic photosensitive member surface, where views (1) each show the surface profile of the profile-providing material (mold) as viewed from its top, and views (2) each show the surface profile of the profile-providing material (mold) as viewed from its side.
Figure 5B:
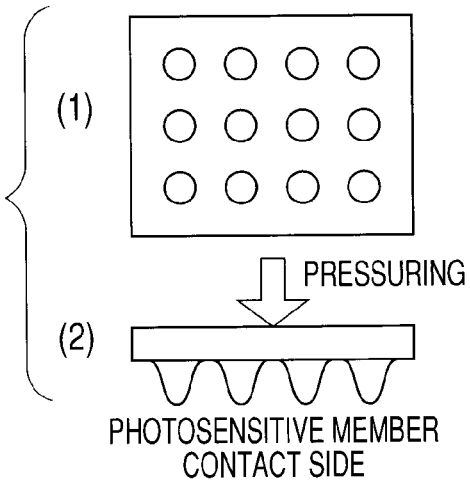

The material, size and surface profile of the profile-providing material itself may appropriately be selected. The material may include, e.g., finely surface-processed metals and silicon wafers the surfaces of which have been patterned using a resist, and fine-particle-dispersed resin films or resin films having a stated fine surface profile which have been coated with a metal. Examples of the surface profile of the profile-providing material are shown in FIGS. 5A and 5B. FIGS. 5A and 5B are each a partial enlarged view of the profile-providing material at its part coming into contact with the electrophotographic photosensitive member surface, in which views (1) each show the surface profile of the profile-providing material as viewed from its top, and views (2) each show the surface profile of the profile-providing material as viewed from its side.

An elastic member may also be provided between the profile-providing material and the pressuring unit for the purpose of providing the electrophotographic photosensitive member with pressure uniformity.

The above method of forming depressions can produce the electrophotographic photosensitive member of the present invention. The depressions may each have any depth within the above range. In the case when the profile-providing material having a stated surface profile is brought into pressure contact with the surface of the electrophotographic photosensitive member to effect surface profile transfer, the depressions may preferably be in a depth (Rdv) of from 0.1 μm or more to 10 μm or less. The employment of the method of forming depressions on the surface of electrophotographic photosensitive member by bringing the profile-providing material having a stated surface profile into pressure contact with the surface of the electrophotographic photosensitive member to effect surface profile transfer enables materialization of the surface processing of the electrophotographic photosensitive member in a high controllability for the size, shape and arrangement of the depressions, in a high precision and at a high degree of freedom.

The method of forming depressions on the surface of the electrophotographic photosensitive member by causing condensation to occur on its surface when the surface layer of the electrophotographic photosensitive member is formed is described next. The method of forming depressions on the surface of the electrophotographic photosensitive member by causing condensation to occur on its surface when the surface layer of the electrophotographic photosensitive member is formed is to form the depressions by a process having the following steps:

A coating step of coating a base member (the member as a base on which the surface layer is to be formed) with a surface layer coating solution which contains a binder resin and a specific aromatic organic solvent and contains the aromatic organic solvent in an amount of from 50% by mass or more to 80% by mass or less, based on the total mass of the solvent in the surface layer coating solution;

a condensation step of subsequently holding the base member having been coated with the surface layer coating solution, to cause condensation to occur on the surface of a coating of the surface layer coating solution applied onto the base member; and a drying step of thereafter heating the coating of the surface layer coating solution to effect drying.

Thus, a surface layer can be formed in which the depressions independent from one another are formed on its surface.

The above binder resin may include, e.g., the following resins: Acrylic resins, styrene resins, polyester resins, polycarbonate resins, polyarylate resins, polysulfone resins, polyphenylene oxide resins, epoxy resins, polyurethane resins, alkyd resins and unsaturated resins.

Of these, polymethyl methacrylate resins, polystyrene resins, styrene-acrylonitrile copolymer resins, polycarbonate resins, polyarylate resins and diallyl phthalate resins are particularly preferred. Polycarbonate resins or polyarylate resins are further preferred. Any of these may be used alone, or in the form of a mixture or copolymer of two or more types.

The above specific aromatic organic solvent is a solvent having a low affinity for water. It may specifically include 1,2-dimethylbenzene, 1,3-dimethylbenzene, 1,4-dimethylbenzene, 1,3,5-trimethylbenzene and chlorobenzene.

It is important that the above surface layer coating solution contains the aromatic organic solvent. The surface layer coating solution may further contain an organic solvent having a high affinity for water, or water, for the purpose of forming the depressions stably. As the organic solvent having a high affinity for water, it may include the following: (Methylsulfinyl) methane (popular name: dimethyl sulfoxide), thiolan-1,1-dione (popular name: sulfolane), N,N-diemthylcarboxyamide, N,N-diethylcarboxyamide, dimethylacetamide and 1-methylpyrrolidin-2-one. Any of these organic solvent may be contained alone or in the form of a mixture of two or more types.

The above condensation step of holding the base member having been coated with the surface layer coating solution, to cause condensation to occur on the surface of a coating of the surface layer coating solution applied onto the base member refers to the step of holding the base member having been coated with the surface layer coating solution, for a certain time in an atmosphere in which condensation occurs on the surface of the coating of the surface layer coating solution applied onto the base member. The condensation in this step refers to a state that droplets have been formed on the surface of the coating of the surface layer coating solution applied onto the base member, by the action of water.

Conditions under which condensation occurs on the surface of the coating of the surface layer coating solution are influenced by relative humidity of the atmosphere in which the base member is to be held and evaporation conditions (e.g., vaporization heat) for the solvent in the surface layer coating solution. As long as the surface layer coating solution contains the aromatic organic solvent in an amount of 50% by mass or more, based on the total mass of the solvent, the conditions for condensation are less influenced by the evaporation conditions for the solvent, and depend chiefly on the relative humidity of the atmosphere in which the base member is to be held. The relative humidity at which condensation occurs on the surface of the coating of the surface layer coating solution may preferably be from 40% to 100%, and much preferably 70% or more. The above step of performing condensation on the surface of the coating of the surface layer coating solution applied onto the base member may be given a time necessary for the droplets to be formed by condensation. From the viewpoint of productivity, this time may preferably be from 1 second to 300 seconds, and may particularly preferably be from 10 seconds to 180 seconds. The relative humidity is important for the step of causing condensation on the surface of the coating of the surface layer coating solution applied onto the base member, and such an atmosphere may preferably have a temperature of from 20° C. to 80° C.

Through the above drying step of heating the coating of the surface layer coating solution to effect drying, depressions are formed on the surface of the electrophotographic photosensitive member correspondingly to the droplets produced on the surface through the step of causing condensation on the surface of the coating of the surface layer coating solution applied onto the base member. In order to form depressions with a high uniformity, it is important for the drying to be quick drying, and hence it is preferable to carry out heat drying. Drying temperature in this drying step may preferably be from 100° C. to 150° C. As the time for the heat drying, a time may be given for which the solvent in the coating solution applied onto the base member and the droplets formed through the condensation step are removed. The time for the heat drying in the drying step may preferably be from 10 minutes to 120 minutes, and may further preferably be from 20 minutes to 100 minutes.

By the above method of forming depressions, a surface layer is formed in which the depressions independent from one another are formed on its surface. This method of forming depressions is a method in which the droplets to be formed by the action of water are formed using the solvent having a low affinity for water and the binder resin, to effect condensation to form the depressions. The depressions formed on the surface of the electrophotographic photosensitive member produced by this forming method are formed by the cohesive force of water, and hence they can be depressions with a high uniformity.

This method of forming depressions is a method which goes through the step of removing droplets, or removing droplets from a state that the droplets have sufficiently grown. Hence, the depressions of the surface of the electrophotographic photosensitive member are, e.g., in the shape of droplets or in the shape of honeycombs (hexagonal shape). The depressions in the shape of droplets refer to depressions looking, e.g., circular or elliptic in observation of the surface of the electrophotographic photosensitive member and depressions looking, e.g., partially circular or partially elliptic in observation of the cross section of the electrophotographic photosensitive member. The depressions in the shape of honeycombs (hexagonal shape) also refer to, e.g., depressions formed as a result of closest packing of droplets on the surface of the electrophotographic photosensitive member. Stated specifically, they are shaped as depressions looking circular, hexagonal or hexagonal with round corners in observation of the surface of the electrophotographic photosensitive member and depressions looking, e.g., partially circular or square pillared in observation of the cross section of the electrophotographic photosensitive member.

The above method of forming depressions can produce the electrophotographic photosensitive member of the present invention. The depressions may each have any depth (Rdv) within the above range. Production conditions may preferably be so set that individual depressions may have a depth of from 0.1 μm or more to 10 μm or less.

Figure 10:
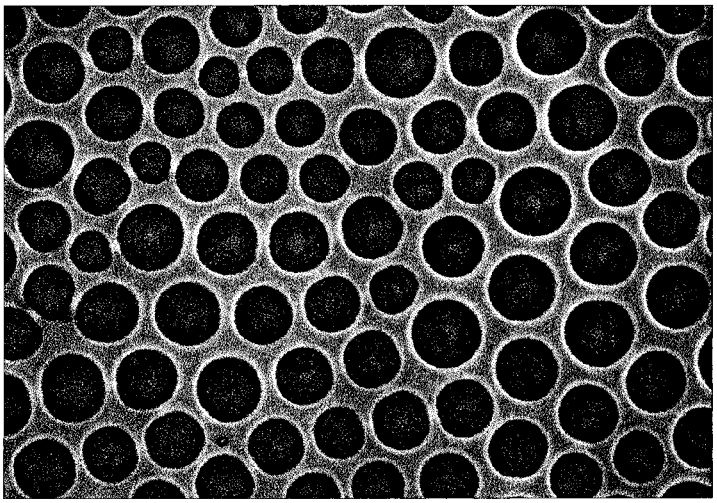
FIG. 10 shows an image of depressions observed on a laser electron microscope, on the surface of a photosensitive member produced in Example 14.

The depressions are controllable by adjusting the above forming conditions. The depressions are controllable by selecting, e.g., the type of the solvent in the surface layer coating solution, the content of the solvent, the relative humidity in the condensation step, the base member retention time in the condensation step, and the heat drying temperature. An example of an image of depressions observed on a laser electron microscope is shown in FIG. 10 where they have been formed on the surface of the electrophotographic photosensitive member by causing condensation to occur on its surface when the surface layer of the electrophotographic photosensitive member is formed.

The silicon-containing compound required in the present invention is described next on its amount necessary in the surface layer and on its structure that is necessary for bringing out the expected effect.

In the present invention, the silicon-containing compound to be incorporated in the surface layer of the electrophotographic photosensitive member is the polymer having a structure represented by the above Formula (1) and a repeating structural unit represented by the above Formula (2) or Formula (3). A polymer having the structure represented by Formula (1) and the repeating structural unit represented by Formula (2) is a siloxane-modified polycarbonate. A polymer having the structure represented by Formula (1) and the repeating structural unit represented by Formula (3) is a siloxane-modified polyester.

Figure 6:
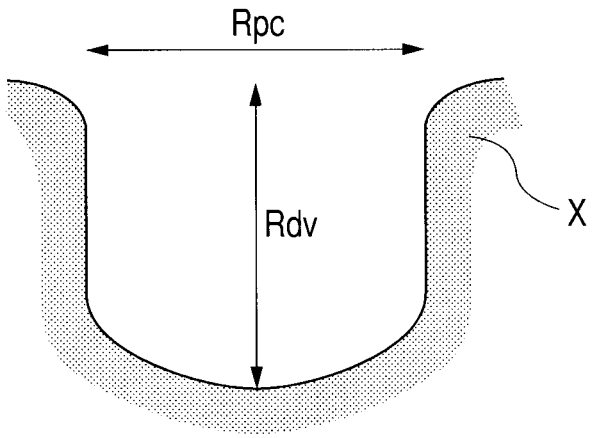
FIG. 6 is a conceptional view showing how the silicon-containing compound is distributed at each depression of the electrophotographic photosensitive member surface obtained according to the present invention.

The siloxane-modified polycarbonate or siloxane-modified polyester, which has the repeating structural unit of the siloxane moiety (Si—O), has a high compatibility with the binder resin for the surface layer, and has a high surface migration when the surface layer is formed. Accordingly, even in a small content, when combined with the depressions described previously, the silicon-containing compound comes much distributed at the surfaces of concaved interiors of the depressions, as shown in FIG. 6. (In FIG. 6, X denotes the part where the silicon-containing compound stands localized.) Hence, the rubbing memory is kept from occurring even though the cleaning blade or charging roller and the electrophotographic photosensitive member have undergone any impact due to the vibration or fall that may come during physical distribution. Even with use of any silicon-containing compound other than the above polymers as exemplified by silicone oils (such as dimethylsilicone oil and modified silicone oil), the lubricity attributable to the repeating structural unit of siloxane moiety can be achieved to a certain extent. However, on the contrary, the positive electric charges due to the friction between the charging member or cleaning blade and the electrophotographic photosensitive member can not well be made less generated, so that the rubbing memory can not well be kept from occurring.

The degree of distribution of the silicon-containing compound in the surface layer at the outermost surface of the surface layer can be known by measuring the proportion of the silicon-containing compound present at the outermost surface. More specifically, the presence proportion [A (% by mass)] of the silicon element to the constituent elements in the surface layer at an inner part of 0.2 μm from the outermost surface of the surface layer of the electrophotographic photosensitive member and the presence proportion [B (% by mass)] of the silicon element to the constituent elements at the outermost surface of the surface layer of the electrophotographic photosensitive member are measured which are determined by X-ray photoelectron spectroscopy (ESCA). The ratio (A/B) of the presence proportion [A (% by mass)] to the presence proportion [B (% by mass)] which have been thus found is calculated, where, as long as this ratio is less than 0.3, the silicon-containing compound may be judged to have sufficiently migrated to the outermost surface in the surface layer and is present in a concentrated state. In the present invention, the ratio (A/B) must be more than 0.0 to less than 0.3. Also, the presence proportion of the silicon element based on constituent elements at the outermost surface of the surface layer must be 0.6% by mass or more.

Further, where the ratio (A/B) is less than 0.1, the silicon-containing compound is considered to be localized substantially only at the outermost surface and in the vicinity thereof, of the surface layer of the electrophotographic photosensitive member. Also, when this is combined with the above specific depressions, the high lubricity the silicon-containing compound has can be brought out to the maximum, and this is preferable because the effect of preventing rubbing memory can more remarkably be obtained.

Here, taking account of the fact that the area measurable by the X-ray photoelectron spectroscopy (ESCA) is about 100 μm in diameter, the measurement may be made without surface processing of the electrophotographic photosensitive member for the depressions of the present invention, and this enables measurement at the outermost surface and at the inner part of 0.2 μm from the outermost surface.

The presence proportion of the silicon element to the constituent elements at the outermost surface and the inner part of 0.2 μm from the outermost surface of the surface layer of the electrophotographic photosensitive member is measured by X-ray photoelectron spectroscopy (ESCA) in the following way.

Instrument used: Quantum 2000 Scanning ESCA Microprope, manufactured by PHI Inc. (Physical Electronics Industries, Inc.).

Conditions for measurement at the outermost surface and the inner part of 0.2 μm after etching:

X-ray source: Al Ka 1,486.6 eV (25 W, 15 kV).
Measurement area: 100 μm.
Spectral region: 1,500 μm×300 μm; angle: 45°.
Pass energy: 117.40 eV.
Etching conditions: Ion gun C60 (10 kV, 2 mm×2 mm); angle: 70°.

As etching time, it takes 1.0 μm/100 minutes to obtain a depth of 1.0 μm from the outermost surface of the surface layer (the depth is identified by SEM observation of cross section after etching of the surface layer). Accordingly, the etching may be made for 20 minutes by using the C60 ion gun and this enables elementary analysis at the inner part of 0.2 μm from the outermost surface of the surface layer.

From the peak intensity of each element that has been measured under the above conditions, surface atom concentration (atom %) is calculated by using relative sensitivity factors offered by PHI Inc. Measured peak top ranges of the respective elements constituting the surface layer are as shown below.

C 1 s: 278 to 298 eV.
F 1 s: 680 to 700 eV.
Si 2 p: 90 to 110 eV.
O 1 s: 525 to 545 eV.
N 1 s: 390 to 410 eV.

The surface layer of electrophotographic photosensitive member of the present invention contains the silicon-containing compound in an amount of less than 0.6% by mass based on the whole solid content in the surface layer, and also the silicon-containing compound in the surface layer has a siloxane moiety in an amount of 0.01% by mass or more, based on the whole solid content in the surface layer. Combining this feature with the above specific depressions and with the feature that the presence proportion of the silicon element as measured by X-ray photoelectron spectroscopy (ESCA) is the stated proportion at the outermost surface and the inner part of 0.2 μm of the surface layer as described above enables prevention of the rubbing memory.

The amount (mass proportion) of the siloxane moiety of the silicon-containing compound based on the whole solid content in the surface layer is what is shown by % by mass about what proportion the mass of the siloxane moiety (Si—O) of the silicon-containing compound holds based on the mass of the whole solid content in the surface layer. Incidentally, a substituent(s) bonded directly to the Si is/are also included in the siloxane moiety (Si—O).

If the silicon-containing compound is in a content of 0.6% by mass or more, based on the whole solid content in the surface layer, though the effect of preventing rubbing memory is seen in some cases, the positive electric charges due to the friction between the charging member or cleaning blade and the electrophotographic photosensitive member can not well be made less generated. Also, in regard to charge characteristics as well, a decrease in image density or the like that is due to an increase in residual potential as a result of repeated service may be seen at the latter half during repeated service of the electrophotographic photosensitive member. If on the other hand the silicon-containing compound is in a content of less than 0.01% by mass based on the whole solid content in the surface layer, the rubbing memory can not be well kept from occurring.

Further, the surface layer of the electrophotographic photosensitive member may contain the silicon-containing compound in an amount of not more than 0.54% by mass based on the whole solid content in the surface layer and also the silicon-containing compound in the surface layer may have the siloxane moiety in an amount of 0.05% by mass or more, based on the whole solid content in the surface layer. This is preferable from the viewpoint of prevention of the rubbing memory.

Preferred examples of the silicon-containing compound used in the present invention are show below, to which, however, the present invention is by no means limited.

The silicon-containing compound used in the present invention is, as described above, the polymer (siloxane-modified polycarbonate or siloxane-modified polyester) having the structure represented by Formula (1) and the repeating structural unit represented by Formula (2) or Formula (3).

Further, among such siloxane-modified polycarbonate or siloxane-modified polyester, much preferred is one having, as structure at the part of at least one terminal, a structure represented by the following Formula (4). Here, the siloxane-modified polycarbonate or siloxane-modified polyester having, as structure at the part of at least one terminal, a structure represented by the following Formula (4) may have the structure represented by Formula (1), in its backbone chain as well.

(4)

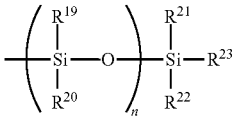

In Formula (4), $R^{19}$ to $R^{23}$ each independently represent a hydrogen atom, a halogen atom, an alkoxyl group, a nitro group, a substituted or unsubstituted alkyl group or a substituted or unsubstituted aryl group; and n represents an average value of the number of repeating structural units each shown in parentheses, and is in the range of from 1 to 500.

The reason why the siloxane-modified polycarbonate or siloxane-modified polyester having, as structure at the part of at least one terminal, the structure represented by Formula (4) is much preferred has not been elucidated in detail. The present inventors presume it as stated below.

That is, having such a polysiloxane at the part of at least one terminal brings an increase in freedom of the siloxane moiety (Si—O), and hence the siloxane-modified polycarbonate or siloxane-modified polyester can have a higher surface migration to come locally concentrated at the outermost surface in the surface layer. Hence, the surface of the electrophotographic photosensitive member exhibits a very high lubricity, and, even in a small content as stated previously, it can well bring the effect of preventing rubbing memory, as so presumed.

One having a longer siloxane chain (more repetition of the siloxane moiety) acts effectively on the improvement in lubricity, where it more exhibits lubricity when the m in Formula (1) and the n in Formula (4) are 10 or more, and exhibits a very high lubricity when they are 20 or more to 60 or less. The silicon-containing compound (the siloxane-modified polycarbonate or siloxane-modified polyester) may also preferably have the siloxane moiety in an amount of from 30.0% by mass or more to 60.0% by mass or less, based on the total mass of the silicon-containing compound. In this case, the silicon-containing compound can have a higher surface migration to achieve both the high lubricity and the less positive electric charges generated due to the friction between the charging member or cleaning blade and the electrophotographic photosensitive member.

The amount of the siloxane moiety based on the total mass of the silicon-containing compound is what is shown by % by mass about what proportion the mass of the siloxane moiety (Si—O) of the silicon-containing compound holds based on the total mass of the silicon-containing compound. Incidentally, a substituent(s) bonded directly to the Si is/are also included in the siloxane moiety (Si—O).

The structure represented by Formula (1) or Formula (4) may include what have been derived from polyalkylsiloxanes, polyarylsiloxanes, polyalkylarylsiloxanes or the like. Stated specifically, it may include polydimethylsiloxane, polydiethylsiloxane, polydiphenylsiloxane and polymethylphenylsiloxane. Any of these may be used alone or may be used in combination of two or more types. The length of the polysiloxane is represented by the m in Formula (1) and the n in Formula (4), where the m and n may each be in the range of from 10 to 500, and may preferably be in the range of from 20 to 60. In order to achieve a sufficient lubricity attributable to the siloxane moiety, it is better for the m and n to be large to a certain extent. However, those in which the m and n are each more than 500 are not practical because a monofunctional phenyl compound having unsaturated groups have inferior reactivity.

Weight average molecular weight (Mw) described later, of the silicon-containing compound may be measured by a conventional method. More specifically, a sample for measurement is put into tetrahydrofuran, and these are left to stand for several hours. Thereafter, with shaking, the sample and the tetrahydrofuran are well mixed together (mixed until coalescent matter of the sample for measurement disappears), and the mixture obtained is further left to stand for 12 hours or more. Thereafter, what has been passed through a sample-treating filter (pore size: 0.45 to 0.5 μm; in the present invention, MAISHORIDISK H-25-5, available from Tosoh Corporation, is used) is used as a sample for GPC (gel permeation chromatography). The sample is so prepared as to be in a concentration of 0.5 to 5 mg/ml.

Using the sample for GPC thus prepared, the weight average molecular weight (Mw) of the sample for measurement is measured in the following way. That is, columns are stabilized in a 40° C. heat chamber. To the columns kept at this temperature, tetrahydrofuran is flowed at a flow rate of 1 ml per minute, and 10 μl of the sample for GPC is injected thereinto to measure the weight average molecular weight Mw) of the sample for measurement. In measuring the weight average molecular weight (Mw) of the sample for measurement, the molecular weight distribution the sample for measurement has is calculated from the relationship between the logarithmic value of a calibration curve prepared using several kinds of monodisperse polystyrene standard samples and the count numbers. As the standard polystyrene samples for preparing the calibration curve, 10 monodisperse polystyrene samples with molecular weights of from 800 to 2,000,000 are used which are available from Aldrich Chemical Co., Inc. An RI (refractive index) detector is used as a detector.

As the columns, it is favorable to use a plurality of polystyrene gel columns in combination, which may include, e.g., columns shown below, available from Tosoh Corporation. The columns shown below may be used in combination of a plurality of columns.

TSK Gel G1000H (HXL), G2000H (HXL), G3000H (HXL), G4000H (HXL), G5000H (HXL), G6000H (HXL) and G7000H (HXL); and TSK Gourd Column.

Specific examples of the siloxane-modified polycarbonate or siloxane-modified polyester having the structure represented by Formula (1) and the repeating structural unit represented by Formula (2) or Formula (3) and having, as structure at the part of at least one terminal, the structure represented by Formula (4) are shown below. Examples of how to synthesize such siloxane-modified polycarbonate or siloxane-modified polyester are also shown below. Note, however, that examples are by no means limited to these in the present invention.

First, examples of materials used to form the repeating structural unit represented by Formula (2) or Formula (3) are shown below.

(2-1)

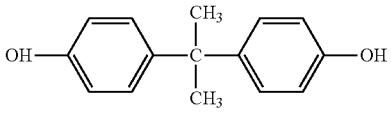

(2-2)

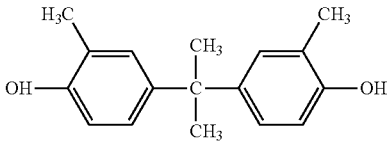

(2-3)

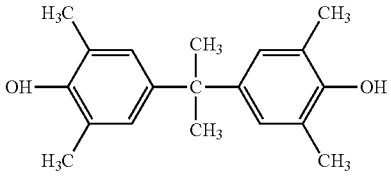

(2-4)

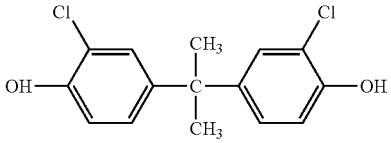

(2-5)

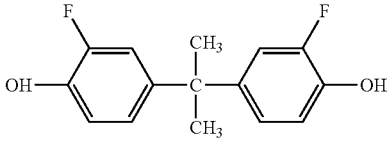

-continued (2-6)

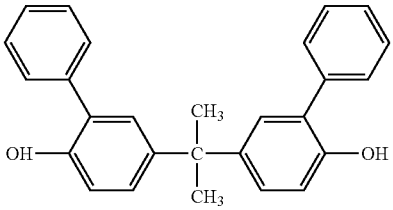

(2-7)

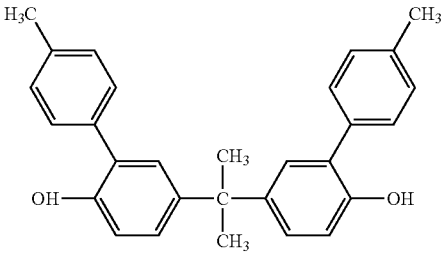

(2-8)

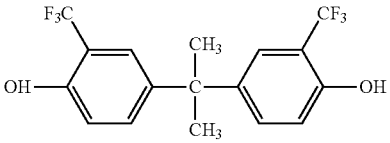

(2-9)

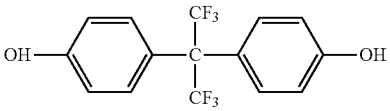

(2-10)

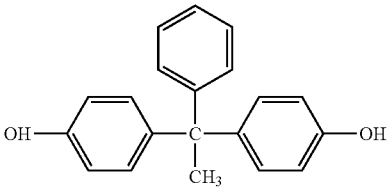

(2-11)

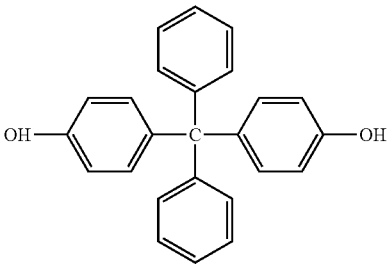

(2-12)

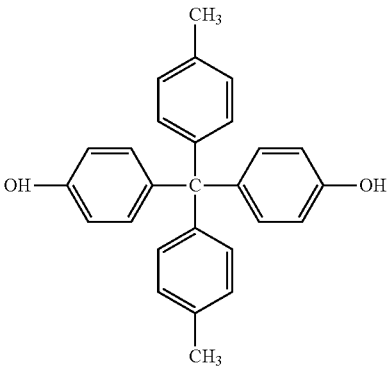

-continued (2-13)

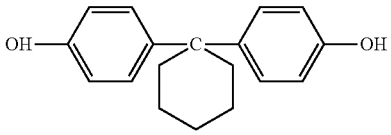

(2-14)

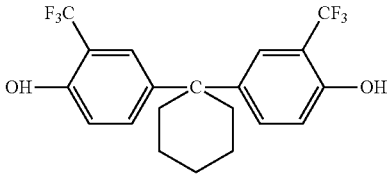

(2-15)

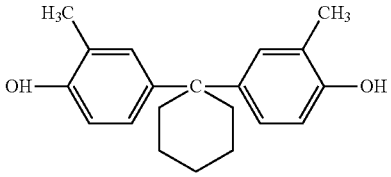

(2-16)

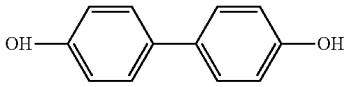

(2-17)

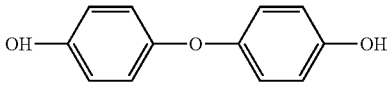

(2-18)

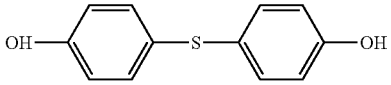

(2-19)

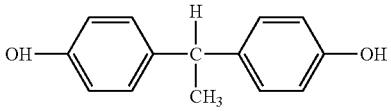

Of these, (2-2) and (2-13) are preferred from the viewpoint of film forming properties for the surface layer.

Next, examples of materials used to form the structure represented by Formula (1) are shown below. In the following materials each, m represents an average value of the number of repeating structural units each shown in parentheses and is in the range of from 1 to 500.

(4-1)

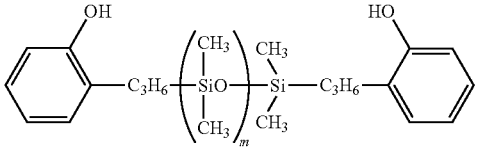

(4-2)

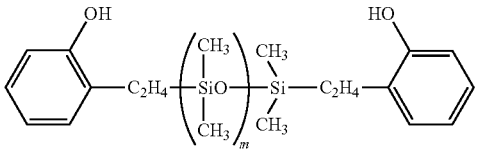

-continued (4-3)

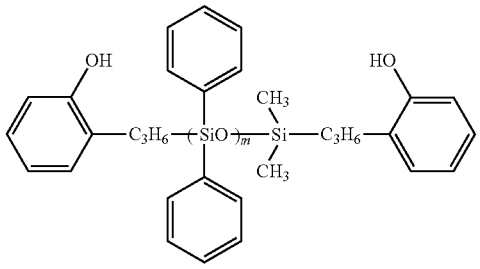

(4-4)

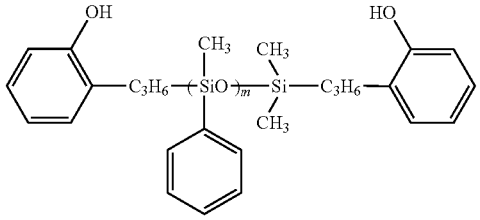

(4-5)

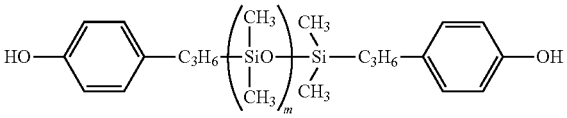

(4-6)

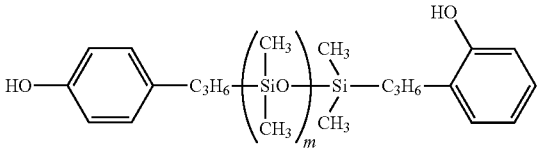

(4-7)

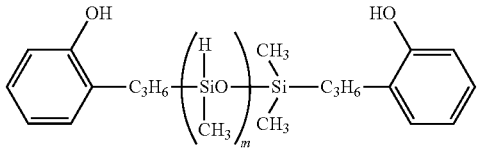

(4-8)

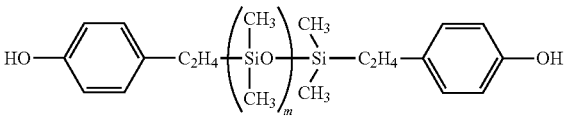

(4-9)

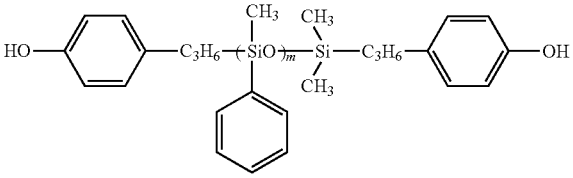

Next, examples of materials used to form the structure represented by Formula (4) are shown below. In the following materials each, n represents an average value of the number of repeating structural units each shown in parentheses and is in the range of from 1 to 500.

(5-1)

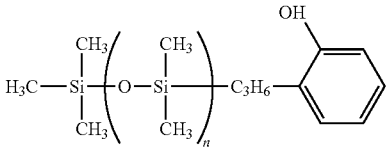

(5-2)

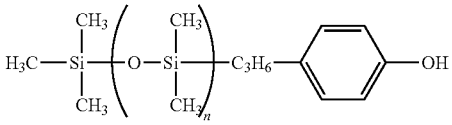

(5-3)

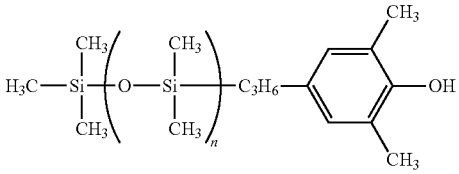

(5-4)

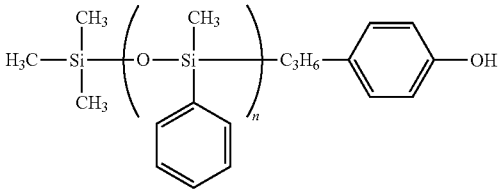

(5-5)

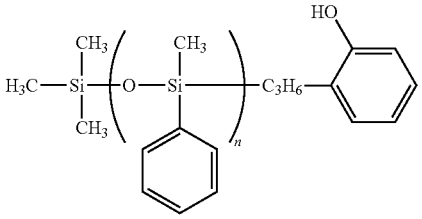

(5-6)

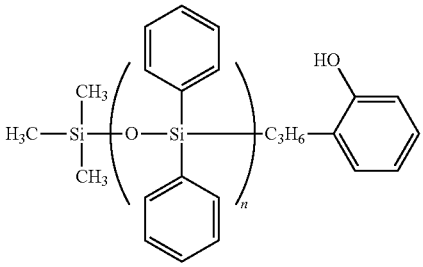

(5-7)

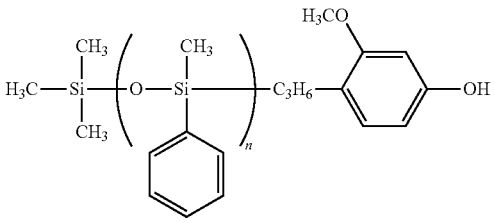

-continued (5-8)

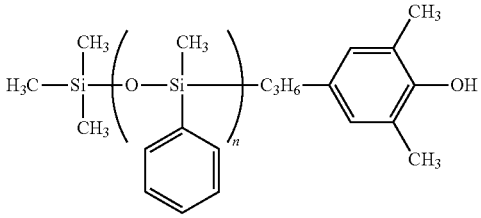

(5-9)

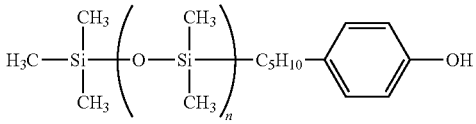

(5-10)

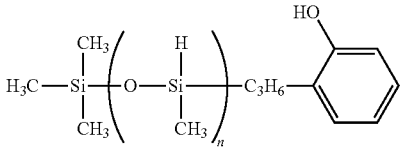

Synthesis examples of the above siloxane-modified polycarbonate or siloxane-modified polyester are shown below.

SYNTHESIS EXAMPLE 1

To 500 ml of an aqueous 10% sodium hydroxide solution, 120 g of a bisphenol represented by the above Formula (2-13) was added and dissolved therein. To the solution thus obtained, 300 ml of dichloromethane was added, followed by stirring, and, while keeping the solution temperature at 10 to 15° C., 100 g of phosgene was blown into it over a period of 1 hour. At the time about 70% of the phosgene was blown thereinto, 10 g of a siloxane compound represented by the above Formula (4-1) (m=20) and 20 g of a siloxane compound represented by the above Formula (5-1) (n=20) were added thereto. After the introduction of the phosgene was completed, the reaction mixture was vigorously stirred to effect emulsification, and then 0.2 ml of triethylamine was added, followed by stirring for 1 hour. Thereafter, the dichloromethane phase was neutralized with phosphoric acid, and was further repeatedly washed with water until it came to be pH 7. Subsequently, this liquid phase was dropwise added to isopropanol, and the precipitate formed was filtered off, followed by drying to obtain a white powdery polymer (siloxane-modified polycarbonate).

The polymer obtained was analyzed by infrared absorption spectral analysis (IR) to ascertain absorption due to a carbonyl group at 1,750 $cm^{-1}$, and absorption due to an ether linkage and absorption due to a carbonate linkage at 1,240 $cm^{-1}$. Also, absorption at 3,650 to 3,200 $cm^{-1}$ was little seen, and any peak due to a hydroxyl group was not seen. Residual phenolic OH level found by molecular absorption spectrophotometry was 112 ppm. A peak at 1,100 to 1,000 $cm^{-1}$ was further ascertained which was due to siloxane.

On the above siloxane-modified polycarbonate, measurement by $^1$H-NMR was also made, and the peak area ratio of hydrogen atoms constituting the siloxane-modified polycarbonate was calculated to ascertain its copolymerization ratio. As the result, it was ascertained that the ratio of the polysiloxane structure formed from the above Formula (4-1) to the polysiloxane structure formed from the above Formula (5-1) was 1:2 and m:n was 20:20. This siloxane-modified polycarbonate also had a viscosity average molecular weight (Mv) of 26,000, an intrinsic viscosity at 20° C. of 0.46 dl/g and had the siloxane moiety therein in an amount (mass proportion) of 20.0% by mass.

This siloxane-modified polycarbonate stands structured to have polysiloxane structures [the structure represented by Formula (4)] at both terminals of the polycarbonate and have a polysiloxane structure also in the backbone chain of the polycarbonate. As a method of measuring the viscosity average molecular weight (Mv), a siloxane-modified polycarbonate or siloxane-modified polyester for measurement is so dissolved in dichloromethane as to be 0.5 w/v % and its intrinsic viscosity at 20° C. is measured. Then, in the present invention, K and a of the Mark-Houwink-Sakurada viscosity equation are set to be $1.23\times10^4$ and 0.83, respectively, to determine the viscosity average molecular weight (Mv).

SYNTHESIS EXAMPLE 2

A siloxane-modified polycarbonate was obtained by synthesis carried out in the same way as that in Synthesis Example 1 except that the siloxane compound represented by Formula (4-1) (m=40) and the siloxane compound represented by Formula (5-1) (n=40) were added in amounts of 25 g and 55 g, respectively. This siloxane-modified polycarbonate had a viscosity average molecular weight (Mv) of 20,600. The following characteristics were also ascertained in the same way as in Synthesis Example 1 by infrared absorption spectral analysis and $^1$H-NMR. That is, in this siloxane-modified polycarbonate, m:n was 40:40. Also, in this siloxane-modified polycarbonate, its siloxane moiety was in an amount (mass proportion) of 40.0% by mass.

This siloxane-modified polycarbonate also stands structured to have polysiloxane structures [the structure represented by Formula (4)] at both terminals of the polycarbonate and have a polysiloxane structure also in the backbone chain of the polycarbonate. Still also, its residual phenolic OH quantity found by molecular absorption spectrophotometry was 175 ppm.

SYNTHESIS EXAMPLE 3

The following components were put into a reaction vessel having a stirrer and then dissolved in 2,720 ml of water.

| | |
|---|---|
| Bisphenol represented by the above Formula (2-2) | 90 g |
| p-tert-Butylphenol | 0.82 g |
| Sodium hydroxide | 33.9 g |
| Polymerization catalyst tri-n-butylbenzyl ammonium chloride | 0.82 g |

Meanwhile, 4 g of the siloxane compound represented by the above Formula (4-1) (m=40) and 8 g of the siloxane compound represented by the above Formula (5-1) (n=40) were dissolved in 500 ml of methylene chloride (organic phase 1).

Separately, 74.8 g of a 1/1 mixture of terephthalic acid chloride and isophthalic acid chloride was dissolved in 1,500 ml of methylene chloride (organic phase 2).

First, the organic phase 1 was added to an aqueous phase under strong stirring and then the organic phase 2 was added, where polymerization reaction was carried out at 20° C. for 3 hours. Thereafter, 15 ml of acetic acid was added to stop the reaction, and then the aqueous phase and the organic phases were separated by decantation. Further, the organic phases thus separated were repeatedly subjected to washing with water and separation by a centrifugal separator. The water used in total in the washing was 50 times the mass of the organic phases. Thereafter, the organic phases were added to methanol to cause a polymer to precipitate. This polymer was separated and then dried to obtain siloxane-modified polyester (a siloxane-modified polyacrylate).

The siloxane-modified polycarbonate or siloxane-modified polyester described above may preferably have a viscosity average molecular weight (Mv) of from 5,000 to 200,000, and, in particular, much preferably from 10,000 to 100,000. In synthesizing any of these, in order to control its molecular weight, other monofunctional compound may be added in combination as a terminal stopper. Such a stopper may include, e.g., compounds such as phenol, p-cumylphenol, p-t-butylphenol, benzoic acid and benzyl chloride, which are usually used in producing polycarbonates.

The siloxane-modified polycarbonate or siloxane-modified polyester may also preferably have a residual moisture content of 0.25% by mass or less. From the viewpoint of electrophotographic performance, the siloxane-modified polycarbonate or siloxane-modified polyester may still also preferably have a residual solvent content of 300 ppm or less and a residual common salt content of 2.0 ppm or less. The siloxane-modified polycarbonate may also preferably have an intrinsic viscosity at 20° C. of less than 10.0 dl/g, and much preferably from 0.1 dl/g to 1.5 dl/g, of a solution of 0.5 g/dl in concentration which contains dichloromethane as a solvent. It may further preferably have a residual phenolic OH level of 500 ppm or less, and much preferably 300 ppm or less, as found by molecular absorption spectrophotometry.

Here, the residual moisture content may be determined in the following way by using Karl Fischer's moisture meter. More specifically, the siloxane-modified polycarbonate or siloxane-modified polyester is dissolved in dichloromethane, and automatic measurement may be made by using Karl Fischer's reagent and a standard methanol reagent to determine moisture concentration. Also, as to the residual solvent content, the siloxane-modified polycarbonate or siloxane-modified polyester may be dissolved in dioxane to make direct quantitative determination by gas chromatography. As to the residual common salt content, chlorine may quantitatively be determined by means of a potential difference measuring instrument to find the concentration of common salt.

The above siloxane-modified polycarbonate or siloxane-modified polyester is contained in an amount of less than 0.6% by mass based on the whole solid content in the surface layer of the electrophotographic photosensitive member. Even in such a small content, the siloxane-modified polycarbonate or siloxane-modified polyester exhibits a high effect in the prevention of rubbing memory in virtue of its localization in the surface layer at its outermost surface and in the vicinity thereof. In view of electrophotographic performance, such a siloxane-modified polycarbonate or siloxane-modified polyester may preferably be used in the state of a mixture with a resin having superior mechanical strength.

The above siloxane-modified polycarbonate or siloxane-modified polyester tends to concentrate at the outermost surface and in the vicinity thereof, of the surface layer of the electrophotographic photosensitive member, and hence, even with its addition in such a small amount as above, can make the surface of the electrophotographic photosensitive member have a high lubricity and also can make the positive electric charges less generated due to the friction between the charging member or cleaning blade and the electrophotographic photosensitive member. Then, combining it with the above specific depressions of the surface enables prevention of rubbing memory even when under severer conditions the electrophotographic photosensitive member have undergone any impact due to the vibration or fall that may come during physical distribution. Also, the surface layer coating solution making use of the siloxane-modified polycarbonate or siloxane-modified polyester has a good transparency, and hence contributes to good electrophotographic performance and good coating performance. For example, 4.0 g of the siloxane-modified polycarbonate synthesized in Synthesis Example 1 is completely dissolved in 20.0 g of a 1/1 (mass ratio) mixed solvent of chlorobenzene and dimethoxymethane by stirring carried out overnight or more. Thereafter, the solution obtained is put into a cell of 1 cm square, and transmittance of the solution at 778 nm is measured with a UV spectrometer, where the solution shows a transmittance of as high as 99% for a blank sample containing the solvent only.

Make-up of the electrophotographic photosensitive member of the present invention is described next.

The electrophotographic photosensitive member of the present invention has, as mentioned previously, a support and a photosensitive layer provided on the support. The electrophotographic photosensitive member may commonly be a cylindrical member in which the photosensitive layer is formed on a cylindrical support, which may also be one having the shape of a belt or sheet.

The photosensitive layer may be either of a single-layer type photosensitive layer which contains a charge transporting material and a charge generating material in the same layer and a multi-layer type (function-separated type) photosensitive layer which is separated into a charge generation layer containing a charge generating material and a charge transport layer containing a charge transporting material. From the viewpoint of electrophotographic performance, the multi-layer type photosensitive layer is preferred. The multi-layer type photosensitive layer may also be either of a regular-layer type photosensitive layer in which the charge generation layer and the charge transport layer are superposed in this order from the support side and a reverse-layer type photosensitive layer in which the charge transport layer and the charge generation layer are superposed in this order from the support side. The regular-layer type photosensitive layer is preferred from the viewpoint of electrophotographic performance. The charge generation layer may be formed in multi-layer structure, and the charge transport layer may also be formed in multi-layer structure. A protective layer may further be provided on the photosensitive layer for the purpose of, e.g., improving durability or running performance.

As the support, it may preferably be one having conductivity (conductive support). For example, usable are supports made of a metal such as aluminum, aluminum alloy or stainless steel. In the case of aluminum or aluminum alloy, usable are an ED pipe, an EI pipe and those obtained by subjecting these pipes to cutting, electrolytic composite polishing (combination of electrolysis carried out using i) an electrode having electrolytic action and ii) an electrolytic solution with polishing carried out using a grinding stone having polishing action) or to wet-process or dry-process honing. Still also usable are the above supports made of a metal, or supports made of a resin, and having layers film-formed by vacuum deposition of aluminum, an aluminum alloy or an indium oxide-tin oxide alloy. Here, the resin used in the supports made of a resin may include, e.g., polyethylene terephthalate, polybutylene terephthalate, phenol resin, polypropylene and polystyrene. Still also usable are supports formed of resin or paper impregnated with conductive particles such as carbon black, tin oxide particles, titanium oxide particles or silver particles, and supports made of a plastic containing a conductive binder resin.

For the purpose of prevention of interference fringes caused by scattering of laser light or the like, the surface of the support may be subjected to cutting, surface roughening or aluminum anodizing.

The support may preferably have, where the surface of the support is a layer provided in order to impart conductivity, a volume resistivity of from $1\times10^{10}$ Ω·cm or less, and, in particular, much preferably $1\times10^{6}$ Ω·cm or less.

A conductive layer intended for the prevention of interference fringes caused by scattering of laser light or the like or for the covering of scratches of the support surface may be provided between the support and an intermediate layer described later or the photosensitive layer (charge generation layer or charge transport layer). This is a layer formed by coating the support with a coating fluid prepared by dispersing a conductive powder in a suitable binder resin.

Such a conductive powder may include carbon black, acetylene black, metallic powders of, e.g., aluminum, nickel, iron, nichrome, copper, zinc and silver, and metal oxide powders such as conductive tin oxide and ITO.

The binder resin may include the following thermoplastic resins, thermosetting resins or photocurable resins: Polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate, phenoxy resins, polycarbonate, cellulose acetate resins, ethyl cellulose resins, polyvinyl butyral, polyvinyl formal, polyvinyltoluene, poly-N-vinyl carbazole, acrylic resins, silicone resins, epoxy resins, melamine resins, urethane resins, phenol resins and alkyd resins.

The conductive layer may be formed by coating a coating fluid prepared by dispersing or dissolving the above conductive powder and binder resin in the following solvent: An ether type solvent such as tetrahydrofuran or ethylene glycol dimethyl ether, an alcohol type solvent such as methanol, a ketone type solvent such as methyl ethyl ketone, or an aromatic hydrocarbon solvent such as toluene.

The conductive layer may preferably have a layer thickness (average layer thickness) of from 0.2 μm or more to 40 μm or less, much preferably from 1 μm or more to 35 μm or less, and still much preferably from 5 μm or more to 30 μm or less.

An intermediate layer having the function as a barrier and the function of adhesion may also be provided between the support or conductive layer and the photosensitive layer (the charge generation layer or the charge transport layer). The intermediate layer is formed for the purposes of, e.g., improving the adherence of the photosensitive layer, improving coating performance, improving the injection of electric charges from the support and protecting the photosensitive layer from any electrical breakdown.

The intermediate layer may be formed by coating an intermediate layer coating solution containing a curable resin and thereafter curing the resin to form a resin layer; or by coating on the support or conductive layer an intermediate layer coating solution containing a binder resin, followed by drying.

The binder resin for the intermediate layer may include the following: Water-soluble resins such as polyvinyl alcohol, polyvinyl methyl ether, polyacrylic acid, methyl cellulose, ethyl cellulose, polyglutamic acid and casein; and polyamide resins, polyimide resins, polyamide-imide resins, polyamic acid resins, melamine resins, epoxy resins, polyurethane resins, and polyglutamate resins.

In order to bring out the electrical barrier properties effectively, and also from the viewpoint of coating performance, adherence, solvent resistance and electrical resistance, the binder resin for the intermediate layer may preferably be a thermoplastic resin. Stated specifically, a thermoplastic polyamide resin is preferred. As the polyamide resin, a low-crystallizable or non-crystallizable copolymer nylon is preferred as being able to be coated in the state of a solution. The intermediate layer may preferably have a layer thickness (average layer thickness) of from 0.05 μm or more to 7 μm or less, and much preferably from 0.1 μm or more to 2 μm or less.

In the intermediate layer, semi-conductive particles may be dispersed or an electron transport material (an electron accepting material such as an acceptor) may be incorporated, in order to make the flow of electric charges (carriers) not stagnate in the intermediate layer.

The photosensitive layer in the present invention is described next.

The charge generating material used in the electrophotographic photosensitive member of the present invention may include the following: Azo pigments such as monoazo, disazo and trisazo pigments, phthalocyanine pigments such as metal phthalocyanines and metal-free phthalocyanine, indigo pigments such as indigo and thioindigo pigments, perylene pigments such as perylene acid anhydrides and perylene acid imides, polycyclic quinone pigments such as anthraquinone and pyrenequinone, squalilium dyes, pyrylium salts and thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, and styryl dyes.

Any of these charge generating materials may be used alone, or may be used in combination of two or more types. Of these, particularly preferred are metal phthalocyanines such as oxytitanium phthalocyanine, hydroxygallium phthalocyanine and chlorogallium phthalocyanine, as having a high sensitivity.

In the case when the photosensitive layer is the multi-layer type photosensitive layer, the binder resin used to form the charge generation layer may include the following: Polycarbonate resins, polyester resins, polyarylate resins, butyral resins, polystyrene resins, polyvinyl acetal resins, diallyl phthalate resins, acrylic resins, methacrylic resins, vinyl acetate resins, phenol resins, silicone resins, polysulfone resins, styrene-butadiene copolymer resins, alkyd resins, epoxy resins, urea resins, and vinyl chloride-vinyl acetate copolymer resins. In particular, butyral resins are preferred. Any of these may be used alone or in the form of a mixture or copolymer of two or more types.

The charge generation layer may be formed by coating a charge generation layer coating fluid obtained by dispersing the charge generating material in the binder resin together with a solvent, followed by drying. The charge generation layer may also be a vacuum-deposited film of the charge generating material. As a method for dispersion, a method is available which makes use of a homogenizer, ultrasonic waves, a ball mill, a sand mill, an attritor or a roll mill. The charge generating material and the binder resin may preferably be in a proportion ranging from 10:1 to 1:10 (mass ratio), and, in particular, much preferably from 3:1 to 1:1 (mass ratio).

The solvent used for the charge generation layer coating fluid may be selected taking account of the binder resin to be used and the solubility or dispersion stability of the charge generating material. The solvent may include alcohol type solvents, sulfoxide type solvents, ketone type solvents, ether type solvents, ester type solvents and aromatic hydrocarbon solvents.

The charge generation layer may preferably be in a layer thickness (average layer thickness) of 5 μm or less, and, in particular, much preferably from 0.1 μm or more to 2 μm or less.

A sensitizer, an antioxidant, an ultraviolet absorber and/or a plasticizer which may be of various types may also optionally be added to the charge generation layer. An electron transport material (an electron accepting material such as an acceptor) may also be incorporated in the charge generation layer in order to make the flow of electric charges (carriers) not stagnate in the charge generation layer.

In the case when the photosensitive layer is the regular-layer type photosensitive layer, the charge transport layer is formed on the charge generation layer. A charge transporting material is contained in the charge transport layer. The charge transporting material may include, e.g., triarylamine compounds, hydrazone compounds, styryl compounds, stilbene compounds, pyrazoline compounds, oxazole compounds, thiazole compounds, and triarylmethane compounds. Only one type of any of these charge transporting materials may be used, or two or more types may be used. In the case when the charge transport layer is the surface layer of the electrophotographic photosensitive member, the above silicon-containing compound is incorporated in the charge transport layer. As long as it is the silicon-containing compound described above, only one type of the compound may be used, or two or more types may be used. Such a charge transport layer may be formed by coating a solution prepared by dissolving the charge transporting material and the silicon-containing compound and further optionally mixing other binder resin, using a suitable solvent, followed by drying. As drying temperature, it may be dried at a temperature of 100° C. or more, where, as long as the above silicon-containing compound is used, it can readily migrate to the outermost surface of the surface layer. Hence, this is preferable from the viewpoint of achieving both the high lubricity and the less positive electric charges generated due to the friction between the charging member or cleaning blade and the electrophotographic photosensitive member.

The binder resin that may be mixed with the silicon-containing compound in the present invention may include, e.g., the following: Acrylic resins, acrylonitrile resins, allyl resins, alkyd resins, epoxy resins, silicone resins, nylons, phenol resins, phenoxy resins, butyral resins, polyacrylamide resins, polyacetal resins, polyamide-imide resins, polyamide resins, polyallyl ether resins, polyarylate resins, polyimide resins, polyurethane resins, polyester resins, polyethylene resins, polycarbonate resins, polystyrene resins, polysulfone resins, polyvinyl butyral resins, polyphenylene oxide resins, polybutadiene resins, polypropylene resins, methacrylic resins, urea resins, vinyl chloride resins and vinyl acetate resins.

In particular, polyarylate resins and polycarbonate resins are much preferred in the sense that, where the siloxane-modified polycarbonate or siloxane-modified polyester is used, the compatibility, the electrophotographic performance and the effect brought by combining surface migration with surface profile are brought out. Any of these may be used alone or in the form of a mixture or copolymer of two or more types.

The charge transporting material and the binder resin may preferably be in a proportion ranging from 2:1 to 1:2 (mass ratio).

The charge transport layer may preferably be in a layer thickness (average layer thickness) of from 5 μm to 50 μm, and, in particular, much preferably from 7 μm to 30 μm.

Additives such as an antioxidant, an ultraviolet absorber and/or a plasticizer may also optionally be added to the charge transport layer.

In the case when the photosensitive layer is of a single-layer type, it may be formed by coating a solution prepared by dispersing and/or dissolving such charge generating material and charge transporting material as those described above, in such a binder resin as one described above, followed by drying.

When the coating solutions or fluids for the above respective layers are coated, any coating method may be used, e.g., dip coating, spray coating, spinner coating, roller coating, Meyer bar coating, blade coating or ring coating.

The coating solutions or fluids used in the coating may each preferably have a viscosity of from 5 mP·s or more to 500 mP·s or less.

The solvent used in the charge transport layer coating fluid may include the following: Ketone type solvents such as acetone and methyl ethyl ketone; ester type solvents such as methyl acetate and ethyl acetate; ether type solvents such as tetrahydrofuran, dioxolane, dimethoxymethane and diethoxymethane; and aromatic hydrocarbon solvents such as toluene, xylene and chlorobenzene.

Any of these solvents may be used alone, or may be used in the form of a mixture of two or more types. Of these solvents, from the viewpoint of resin dissolving properties and so forth, it is preferable to use ether type solvents or aromatic hydrocarbon solvents.

The charge transport layer may preferably be in a layer thickness (average layer thickness) of from 5 μm to 50 μm, and, in particular, much preferably from 10 μm to 35 μm.

Where it is necessary to more improve the electrophotographic photosensitive member in its running performance, a make-up may be employed in which a second charge transport layer or a protective layer is formed as the surface layer of the electrophotographic photosensitive member. In such a case, the above silicon-containing compound is incorporated in a coating solution for the second charge transport layer or protective layer. Then, using this coating solution, a second charge transport layer or a protective layer must be formed which has the above specific depressions on its surface.

The second charge transport layer or protective layer may be formed using a binder resin (thermoplastic resin) having plasticity. In order to more improve the electrophotographic photosensitive member in its running performance, it is preferable to form it using a curable resin.

As a method in which the surface layer is formed of such a curable resin, a method is available in which the charge transport layer is formed of the curable resin. A method is also available in which the second charge transport layer or protective layer is formed using the curable resin. Properties required in a layer making use of the curable resin are both film strength and charge-transporting ability, and such a layer is commonly made up of a charge-transporting material and a polymerizable or cross-linkable monomer or oligomer.

In the method in which the surface layer of the electrophotographic photosensitive member is formed of the curable resin, any known hole-transporting compound or electron-transporting compound may be used as the charge-transporting material. A material for synthesizing these compounds may include chain polymerization type materials having an acryloyloxyl group or a styrene group. It may also include successive polymerization type materials having a hydroxyl group, an alkoxysilyl group or an isocyanate group. In particular, from the viewpoints of electrophotographic performance, general-purpose properties, material designing and production stability of the electrophotographic photosensitive member the surface layer of which is the layer (cured layer) formed of the curable resin, it is preferable to use the hole-transporting compound and the chain polymerization type material in combination. Further, an electrophotographic photosensitive member is particularly preferred which has a surface layer formed by curing a compound having both the hole-transporting compound and the acryloyloxyl group in the molecule.

As a curing means, any known means may be used which makes use of heat, light or radiation.

Such a cured layer as the surface layer of the electrophotographic photosensitive member may preferably be, in the case when the surface layer is the (first) charge transport layer, in a layer thickness (average layer thickness) of from 5 μm or more to 50 μm or less, and much preferably from 10 μm or more to 35 μm or less. In the case when the surface layer is the second charge transport layer or protective layer, it may preferably be in a layer thickness of from 0.3 μm or more to 20 μm or less, and much preferably from 1 μm or more to 10 μm or less.

Various additives may be added to the respective layers of the electrophotographic photosensitive member of the present invention. Such additive may include deterioration preventives such as an antioxidant and an ultraviolet absorber.

The process cartridge and electrophotographic apparatus of the present invention are described next. The process cartridge of the present invention is one having the electrophotographic photosensitive member described above and supported integrally therewith a cleaning means, and being detachably mountable to the main body of an electrophotographic apparatus. The process cartridge of the present invention also has, as the cleaning means, a cleaning blade which is provided in touch with, and in the direction counter to, the surface of the electrophotographic photosensitive member. The process cartridge of the present invention may further have a charging means, a developing means and/or a transfer means. The electrophotographic apparatus of the present invention is one having the electrophotographic photosensitive member described above, a charging means, an exposure means, developing means, a transfer means and a cleaning means; the cleaning means having a cleaning blade which is provided in touch with, and in the direction counter to, the surface of the electrophotographic photosensitive member. As the charging means, it may preferably be one having a charging roller provided in contact with the surface of the electrophotographic photosensitive member.

Figure 7:
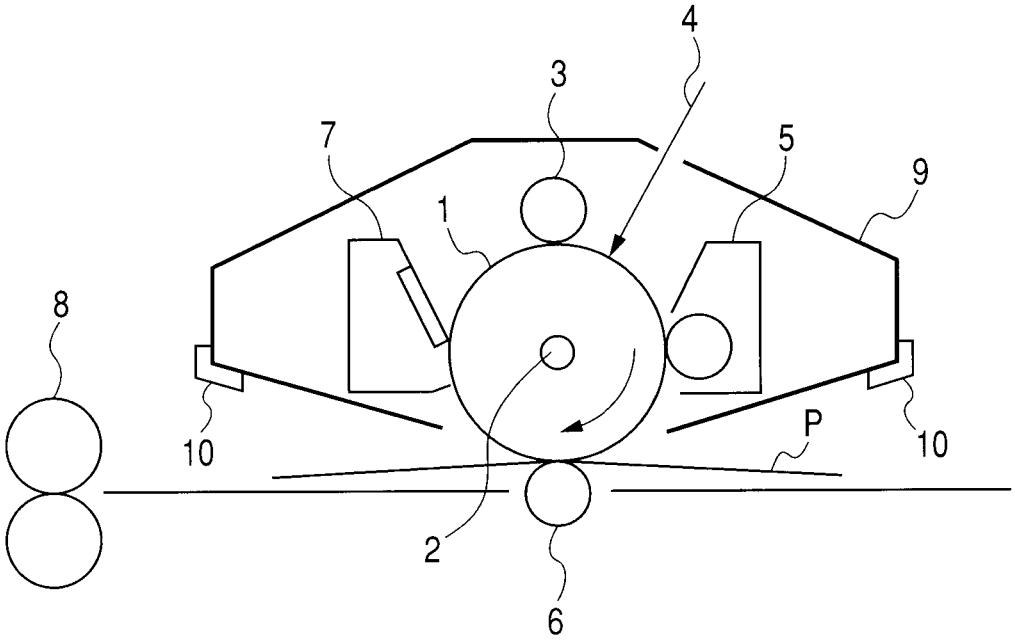
FIG. 7 is a schematic view showing an example of the construction of an electrophotographic apparatus provided with a process cartridge having the electrophotographic photosensitive member of the present invention.

FIG. 7 is a schematic view showing an example of an electrophotographic apparatus provided with a process cartridge having the electrophotographic photosensitive member of the present invention. In FIG. 7, reference numeral 1 denotes a cylindrical electrophotographic photosensitive member, which is rotatingly driven around an axis 2 in the direction of an arrow at a stated peripheral speed.

The surface of the electrophotographic photosensitive member 1 driven rotatingly is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer a developing means 5 has, to form toner images. Then, the toner images thus formed and held on the surface of the electrophotographic photosensitive member 1 are successively transferred by the aid of a transfer bias applied from a transfer means (such as a transfer roller) 6, which are successively transferred on to a transfer material (such as paper) P. The transfer material P may be fed from a transfer material feed means (not shown) to the part (contact zone) between the electrophotographic photosensitive member 1 and the transfer means 6 in the manner synchronized with the rotation of the electrophotographic photosensitive member 1.

The transfer material P to which the toner images have been transferred is separated from the surface of the electrophotographic photosensitive member 1 and led into a fixing means 8, where the toner images are fixed, and is then put out of the apparatus as an image-formed material (a print or a copy).

The surface of the electrophotographic photosensitive member 1 from which the toner images have been transferred is brought to removal of the developer (toner) remaining after the transfer, through a cleaning means (having a cleaning blade which is provided in touch with, and in the direction counter to, the surface of the electrophotographic photosensitive member) 7. Thus, its surface is cleaned. The toner having remained on the surface of the electrophotographic photosensitive member from which the toner images have been transferred is also collected by the cleaning means 7.

In order that a polymerization toner having been made smaller in particle diameter, in recent years are removed by cleaning, it may often be necessary for the electrophotographic photosensitive member and the cleaning blade to be set at a touch linear pressure of from 30 N/m or more to 120 N/m or less where the force applied per unit length in the touch lengthwise direction between them is termed as touch linear pressure. It may often be necessary for the electrophotographic photosensitive member and the cleaning blade to be set at a touch angle of from 25° or more to 30° or less, which is in a range of higher touch angle than ever.

In general, there is a tendency that the resistance of friction between the electrophotographic photosensitive member and the cleaning blade decreases with a decrease in contact (or touch) area because of any unevenness profile the electrophotographic photosensitive member has on its surface. However, in the case when the cleaning blade and the electrophotographic photosensitive member are set at the high touch linear pressure and high touch angle as stated above, the cleaning blade, as being an elastic material in itself, may necessarily follow up the surface profile of the electrophotographic photosensitive member. Hence, in some cases the rubbing memory can not be prevented when they undergo any impact due to the vibration or fall that may come during physical distribution. In the electrophotographic photosensitive member of the present invention, the surface of the electrophotographic photosensitive member has the above specific depressions and also has the surface layer in which the silicon-containing compound having specific structure is distributed at the outermost surface and in the vicinity thereof. Thus, even in the case as stated above, the cleaning blade can be kept from following up as above and the silicon-containing compound of the present invention can effectively make positive electric charges less generated. Thus, the rubbing memory can more remarkably be prevented than any conventional electrophotographic photosensitive members.

From the viewpoint of the prevention of rubbing memory, the depressions of the present invention may preferably stand formed over the whole region of the surface layer of the electrophotographic photosensitive member, and may preferably be formed at least at the region where the cleaning blade comes into touch with the surface layer of the same.

It is common for the cleaning blade to be coated at its blade edge with, besides the toner, inorganic particles of carbon fluoride, cerium oxide, titanium oxide, silica or the like. This enables improvement in lubricity to the electrophotographic photosensitive member and prevention of the rubbing memory that may come during physical distribution. However, the electrophotographic photosensitive member of the present invention can maintain a high lubricity even with its repeated service because it has greatly high lubricity on its surface and because of combination with the surface layer having the depressions specified in the present invention. Accordingly, the rubbing memory can be prevented even though the cleaning blade is not coated with any lubricant, and good images can be obtained from the initial stage.

The surface of the electrophotographic photosensitive member may further be subjected to charge elimination (destaticization) by pre-exposure light (not shown) emitted from a pre-exposure means (not shown), and may thereafter repeatedly be used for the formation of images.

In the apparatus shown in FIG. 7, the electrophotographic photosensitive member 1 and the charging means 3, developing means 5 and cleaning means 7 are integrally supported to form a cartridge to set up a process cartridge 9 that is detachably mountable to the main body of the electrophotographic apparatus through a guide means 10 such as rails provided in the main body of the electrophotographic apparatus.

EXAMPLES

The present invention is described below in greater detail by giving Examples. In the following Examples, "part(s)" means "part(s) by weight".

Example 1

An aluminum cylinder of 30 mm in diameter and 260.5 mm in length was used as a support (cylindrical support).

Next, the following components were subjected to dispersion for about 20 hours by means of a ball mill to prepare a conductive layer coating fluid.

| | |
|---|---|
| Powder composed of barium sulfate particles having coat layers of tin oxide (trade name: PASTRAN PC1; available from Mitsui Mining & Smelting Co., Ltd.) | 60 parts |
| Titanium oxide (trade name: TITANIX JR; available from Tayca Corporation) | 15 parts |
| Resol type phenol resin (trade name: PHENOLITE J-325; available from Dainippon Ink & Chemicals, Incorporated; solid content: 60%) | 43 parts |
| Silicone oil (trade name: SH28PA; available from Toray Silicone Co., Ltd.) | 0.015 part |
| Silicone resin (trade name: TOSPEARL 120; available from Toshiba Silicone Co., Ltd.) | 3.6 parts |
| 2-Methoxy-1-propanol | 50 parts |
| Methanol | 50 parts |

This conductive layer coating fluid thus prepared was coated on the above support by dip coating, followed by heating for 1 hour in an oven heated to 140° C., to effect curing to form a conductive layer with a layer thickness (average layer thickness) of 15 μm at the position of 130 mm from the support upper end.

Next, the following components were dissolved in a mixed solvent of 400 parts of methanol and 200 parts of n-butanol to prepare an intermediate layer coating solution.

| | |
|---|---|
| Copolymer nylon resin (trade name: AMILAN CM800; available from Toray Industries, Inc.) | 10 parts |
| Methoxymethylated nylon 6 resin (trade name: TORESIN EF-30T; available from Teikoku Chemical Industry Co., Ltd.). | 30 parts |

This intermediate layer coating solution was coated on the conductive layer by dip coating, followed by heating for 30 minutes in an oven heated to 100° C., to effect drying to form an intermediate layer with a layer thickness (average layer thickness) of 0.65 μm at the position of 130 mm from the support upper end.

Next, the following components were subjected to dispersion for 4 hours by means of a sand mill making use of glass beads of 1 mm in diameter, and then 700 parts of ethyl acetate was added to prepare a charge generation layer coating fluid.

| | |
|---|---|
| Hydroxygallium phthalocyanine (one having strong peaks at Bragg angles of 2θ ± 0.2°, of 7.5°, 9.9°, 16.3°, 18.6°, 25.1° and 28.3° in CuKα characteristics X-ray diffraction) | 20 parts |
| Carixarene compound represented by the following structural formula (5) | 0.2 part |
| Polyvinyl butyral (trade name: S-LEC BX-1, available from Sekisui Chemical Co., Ltd.) | 10 parts |
| Cyclohexanone | 600 part |

(5)

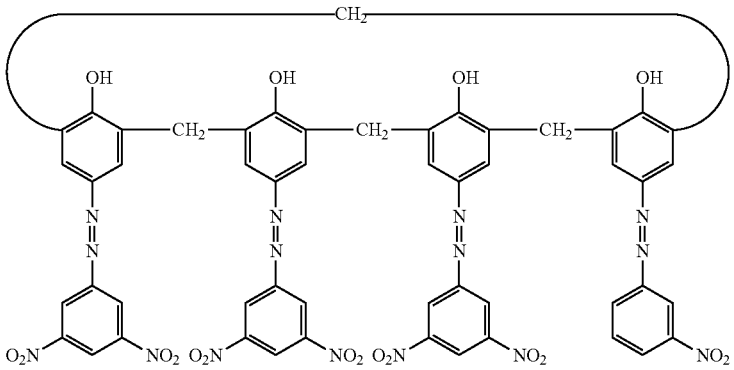

The above charge generation layer coating fluid was coated on the intermediate layer by dip coating, followed by heating for 10 minutes in an oven heated to 100° C., to effect drying to form a charge generation layer with a layer thickness (average layer thickness) of 0.17 μm at the position of 130 mm from the support upper end.

Next, the following components were dissolved in a mixed solvent of 350 parts of chlorobenzene and 150 parts of dimethoxymethane to prepare a charge transport layer coating solution.

| | |
|---|---|
| Compound represented by the following structural formula (6) | 35 parts |
| Compound represented by the following structural formula (7) | 5 parts |
| Copolymerization type polyarylate represented by the following structural formula (8) | 50 parts |

-continued

| | |
|---|---|
| Siloxane-modified polycarbonate (1) having structural units shown in Table 1, having the siloxane structure only in the backbone chain | 0.49 part |

(6)

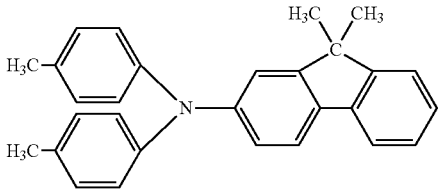

(7)

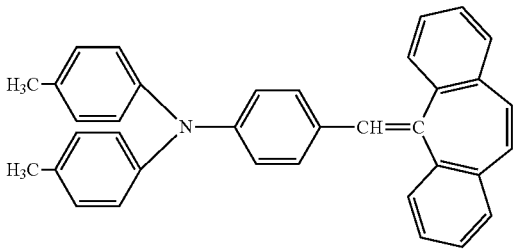

(8)

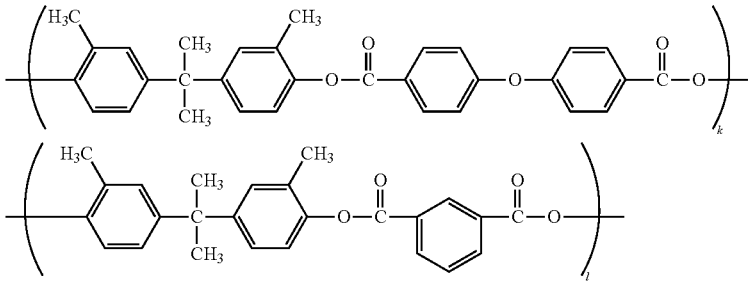

In the formula (8), k and l represent the ratio of repeating structural units in this resin (i.e., copolymerization ratio). In this resin, k:l is 7:3.

In the above polyacrylate, the terephthalic acid structure and the isophthalic acid structure are in a molar ratio (terephthalic acid skeleton:isophthalic acid skeleton) of 50:50, and this polyacrylate has a weight average molecular weight (Mw) of 120,000.

As a method of synthesizing the siloxane-modified polycarbonate (1), it was synthesized by the method according to Synthesis Example 1 given previously. As a siloxane compound used in this synthesis, 30 g of the siloxane compound represented by Formula (4-1) (m=15) only was used.

This charge transport layer coating solution was coated on the charge generation layer by dip coating, followed by heating for 30 minutes in an oven heated to 110° C., to effect drying to form a charge transport layer with a layer thickness (average layer thickness) of 20 μm at the position of 130 mm from the support upper end.

Thus, an electrophotographic photosensitive member was produced which had the support, the intermediate layer, the charge generation layer and the charge transport layer in this order and this charge transport layer was the surface layer.

Elementary Analysis by ESCA at Outermost Surface and at Inner Part of 0.2 μm from Outermost Surface:

The degree of distribution of the silicon-containing compound in the surface layer was measured by ESCA (X-ray photoelectron spectroscopy). As stated previously, taking account of the fact that the area measurable by the ESCA is in the range of a circular area of about 100 μm in diameter, the measurement was made without surface processing of the electrophotographic photosensitive member for the depressions of the present invention to make measurement at the outermost surface and at the inner part of 0.2 μm from the outermost surface.

Data on the following items i) and ii) are shown in Table 2.

i) Presence proportion of silicon element to constituent elements at outermost surface of surface layer of electrophotographic photosensitive member.

ii) The ratio of the presence proportion A (% by mass) of the silicon element to the constituent elements in the surface layer of the electrophotographic photosensitive member at an inner part of 0.2 μm from the outermost surface thereof and the presence proportion B (% by mass) of the silicon element to the constituent elements at the outermost surface of the surface layer of the electrophotographic photosensitive member, A/B, as measured by X-ray photoelectron spectroscopy (ESCA).

Conditions for measurement were as shown below. Instrument used: Quantum 2000 Scanning ESCA Microprobe, manufactured by PHI Inc. (Physical Electronics Industries, Inc.).

Conditions for measurement at the outermost surface and the inner part of 0.2 μm after etching:

X-ray source: Al Ka 1,486.6 eV (25 W, 15 kV).

Measurement area: 100 μm.

Spectral region: 1,500 μm×300 μm.

Angle: 45°.

Pass energy: 117.40 eV.

Etching conditions: Ion gun C60 (10 kV, 2 mm×2 mm); angle: 70°.

As etching time, it took 1.0 μm/100 minutes to obtain a depth of 1.0 μm from the outermost surface of the charge transport layer (the depth was identified by SEM observation of cross section after etching of the charge transport layer). Accordingly, as compositional analysis at the inner part of 0.2 μm from the outermost surface, the etching was made for 20 minutes by using the C60 ion gun and this enabled elementary analysis at the inner part of 0.2 μm from the outermost surface.

From the peak intensity of each element that was measured under the above conditions, surface atom concentration (atom %) was calculated by using relative sensitivity factors offered by PHI Inc. Measured peak top ranges of the respective elements constituting the surface layer were as shown below.

C 1 s: 278 to 298 eV.

F 1 s: 680 to 700 eV.

Si 2 p: 90 to 110 eV.

O 1 s: 525 to 545 eV.

N 1 s: 390 to 410 eV.

Figure 8A:
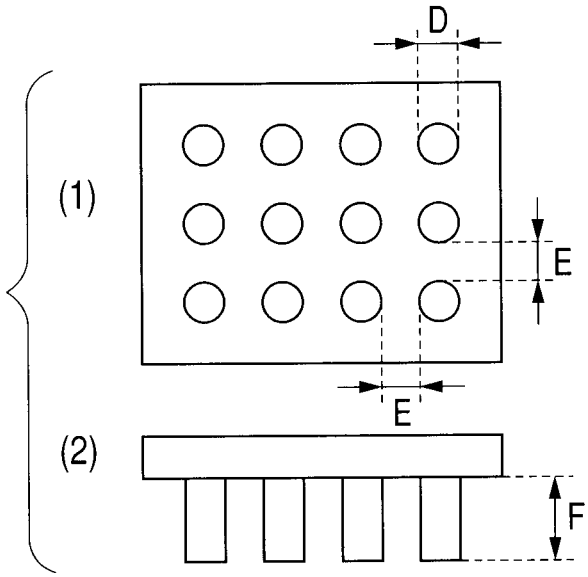
FIG. 8A is a view (partial enlarged view) showing a surface profile of a profile-providing material (mold) used in Example 1.

Processing for Forming Depressions of Electrophotographic Photosensitive Member Surface:

The profile-providing material for column-shaped surface profile transfer as shown in FIG. 8A was set in the processing unit shown in FIG. 4B (the height shown by F of each column-shaped projection was 2.9 μm, the major-axis diameter shown by D of each column-shaped projection was 2.0 μm and the interval shown by E between each column-shaped projection was 0.5 μm). Using this processing unit, the electrophotographic photosensitive member produced in the manner described above was subjected to surface processing over the whole region of its surface. The temperatures of the electrophotographic photosensitive member and profile-providing material at the time of the surface processing was controlled at 110° C., and the electrophotographic photosensitive member was rotated in its peripheral direction with pressuring at a pressure of 50 kg/cm$^2$ to perform surface profile transfer. In FIG. 8A, a view (1) shows the surface profile of the profile-providing material as viewed from its top, and a view (2) shows the surface profile of the profile-providing material as viewed from its side.

Surface Profile Measurement of Electrophotographic Photosensitive Member:

The surface of the electrophotographic photosensitive member produced as described above (surface-processed electrophotographic photosensitive member) was observed with an ultradepth profile measuring microscope VK-9500 (manufactured by Keyence Corporation). The measuring object electrophotographic photosensitive member was placed on a stand which was so worked that its cylindrical support was able to be vertically fastened, where the surface of the electrophotographic photosensitive member was observed at the position of 130 mm distant from its upper end. Here, the objective lens was set at 50 magnifications under observation in a visual field of 100 μm×100 μm (10,000 μm$^2$) of the surface of the electrophotographic photosensitive member. The depressions observed in the visual field of measurement were analyzed by using the analytical program.

The shape of each depression at its surface space within the visual field of measurement, the major-axis diameter (Rpc) thereof and the depth (Rdv) that shows the distance between the deepest part of each depression and the open top thereof were measured. Then, an average of major-axis diameters of individual depressions was taken to express it as average major-axis (Rpc-A), and an average of depths of individual depressions was taken to express it as average depth (Rdv-A). The ratio of the average depth (Rdv-A) to the average major-axis (Rpc-A), Rdv-A/Rpc-A, was also found.

Figure 8B:
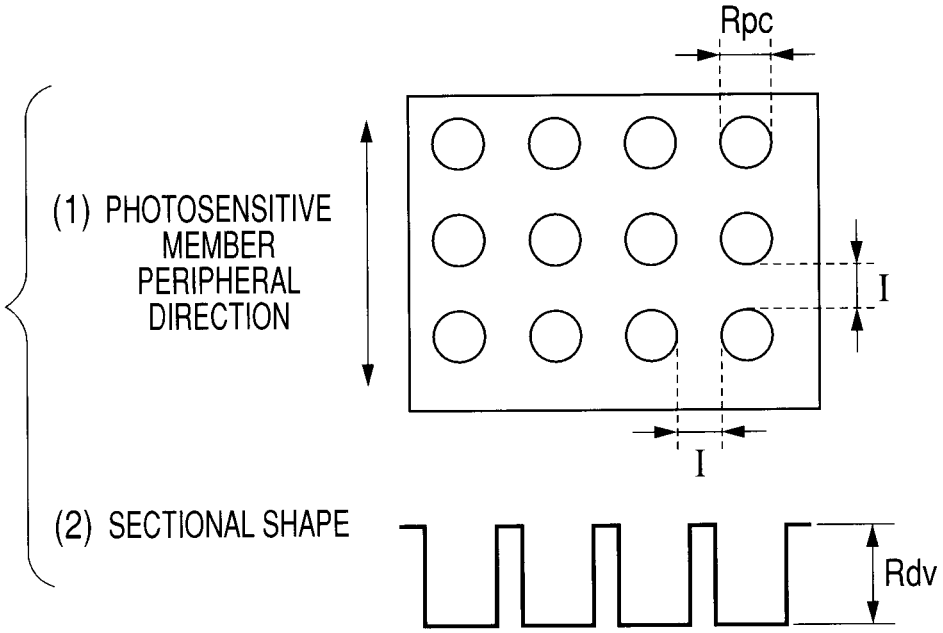
FIG. 8B is a view (partial enlarged view) showing an arrangement pattern of depressions of the photosensitive member surface obtained according to Example 1.
Figure 9A:
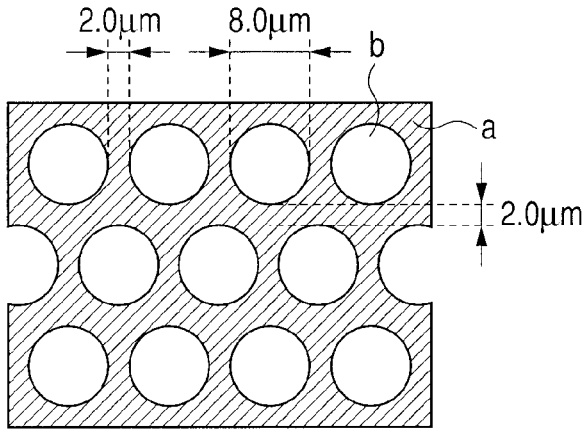
FIG. 9A is a view (partial enlarged view) showing an arrangement pattern of a mask used in Example 11.
Figure 9B:
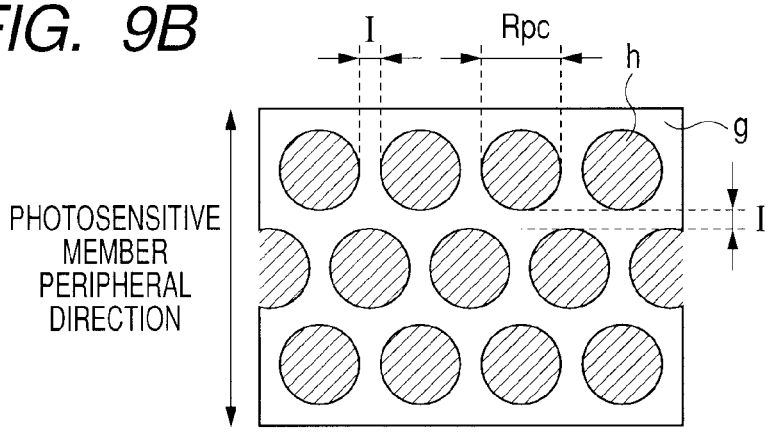
FIG. 9B is a view (partial enlarged view) showing an arrangement pattern of depressions of the photosensitive member surface obtained according to Example 11.

It was ascertained that columnar depressions as shown in FIG. 8A stood formed on the surface of the electrophotographic photosensitive member, where the interval I between the depressions was 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 1,600 depressions. In FIG. 8B, a view (1) shows an arrangement pattern of depressions as viewed in the peripheral direction which were formed on the surface of the electrophotographic photosensitive member, and a view (2) shows sectional shapes of the depressions. The values of Rpc-A, Rdv-A and Rdv-A/Rpc-A measured are shown in Table 2. The depressions formed all had the same shape, and hence the values of Rpc-A, Rdv-A and Rdv-A/Rpc-A are the same as the values of Rpc, Rdv and Rdv/Rpc.

Performance Evaluation on Rubbing Memory of Electrophotographic Photosensitive Member:

The electrophotographic photosensitive member produced and surface-processed in the manner described above was set in a conversion unit of a process cartridge of a laser beam printer COLOR LASER JET 4600 (manufactured by Hewlett-Packard Co.), and evaluation was made by a vibration test as shown below. The process cartridge was so converted that the spring pressure of its charging member was changed to 1.5 times and the touch pressure of its cleaning blade (an elastic cleaning blade) against the electrophotographic photosensitive member and the touch angle between the cleaning blade and the electrophotographic photosensitive member were set at 70 N/m and 28°, respectively. Here, the cleaning blade was not coated with any lubricant (the powder such as toner or fine silicone resin particles for providing it with lubricity).

The vibration test was conducted according to the physical distribution test standard (JIS 20230) in an environment of 15° C. temperature and 10% relative humidity. The process cartridge was placed in a vibration tester (EMIC CORP. Model 905-FN). Thereafter, in this tester, the process cartridge was vibrated at frequencies of 10 Hz to 100 Hz, at an overspeed of 1 G, at a sweep direction of LIN SWEEP, for a reciprocal sweep time of 5 minutes and for a test time of 2 hours in the respective directions of axes x, y and z. Thereafter, about each of what had been left to stand for 5 minutes and what had been left to stand for 2 hours, halftone images were reproduced by using the above printer. The evaluation on rubbing memory was visually made to make evaluation according to the following ranks.

A: Any faulty images (horizontal black tones) due to rubbing memory do not appear.

B: Faulty images due to very slight rubbing memory appear only at the position of touch with the cleaning blade.

C: Faulty images due to rubbing memory appear at the position of touch with the cleaning blade and faulty images due to very slight rubbing memory appear at the position of touch with the charging roller.

D: Faulty images due to remarkable rubbing memory appear at the position of touch with the cleaning blade and faulty images due to rubbing memory appear at the position of touch with the charging roller.

E: Faulty images due to remarkable rubbing memory appear at both the position of touch with the cleaning blade and the position of touch with the charging roller.

The results are shown in Table 2 together.

Performance Evaluation on Positive-Charge Attenuation of Electrophotographic Photosensitive Member:

The electrophotographic photosensitive member produced and surface-processed in the manner described above was set in the above conversion unit of the process cartridge of the laser beam printer COLOR LASER JET 4600 (manufactured by Hewlett-Packard Co.), and evaluation was made by a method as shown below.

The evaluation was made in an environment of 15° C. temperature and 10% relative humidity. Also, the charging roller was so fastened as not to follow up with the electrophotographic photosensitive member, and this cartridge was set in the printer, where, in the state the electrophotographic photosensitive member was neither charged nor exposed to light, it was rotatingly driven until it came to be positively charged to 50 V, and thereafter stopped being rotatingly driven. After rotatingly driven and stopped in this way, the electrophotographic photosensitive member was left to stand for 1 minute, in the state of which the level of attenuation of positive charge was measured to find attenuation percentage of positive charge. The attenuation percentage of positive charge was found according to the following expression. However, one not charged to 50 V even though rotatingly driven for 5 minutes was stopped after 5 minutes being rotatingly driven, where the quantity of charge at that point of time and the level of attenuation of positive charge in the state the electrophotographic photosensitive member was thereafter left to stand for 1 minute were measured, and the positive-charge attenuation percentage was calculated according to the following expression. The results are shown in Table 2.

Positive-charge attenuation percentage=[(charge quantity (V) immediately after stop of rotational drive−charge quantity (V) after 1 minute)/(positive-charge quantity)]×100%.

Example 2

An electrophotographic photosensitive member was produced and its surface was processed both in the same way as that in Example 1 except that, in producing the electrophotographic photosensitive member in Example 1 and about the silicon-containing compound added to the surface layer, the amount 0.49 part of the siloxane-modified polycarbonate (1) added, having structural units shown in Table 1 and having the siloxane structure only in the backbone chain, was changed to 0.1 part.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 1,600 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 3

An electrophotographic photosensitive member was produced and its surface was processed both in the same way as that in Example 1 except that, in producing the electrophotographic photosensitive member in Example 1, the silicon-containing compound to be added to the surface layer was changed for a siloxane-modified polycarbonate (2) having structural units shown in Table 1 and was added in an amount changed to 0.18 part.

Here, as a method of synthesizing the siloxane-modified polycarbonate (2), it was synthesized by the method according to Synthesis Example 1 given previously. As a siloxane compound used in this synthesis, 52 g of the siloxane compound represented by Formula (4-1) (m=40) only was used.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 1,600 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 4

An electrophotographic photosensitive member was produced in the same way as that in Example 1 except that, in producing the electrophotographic photosensitive member in Example 1, the silicon-containing compound to be added to the surface layer was changed for a siloxane-modified polycarbonate (3) having structural units shown in Table 1 and was added in an amount changed to 0.3 part.

Here, as a method of synthesizing the siloxane-modified polycarbonate (3), it was synthesized by the method according to Synthesis Example 2 given previously. As siloxane compounds used here, 25 g of the siloxane compound represented by Formula (4-1) (m=40) and 55 g of the siloxane compound represented by Formula (5-1) (n=40) were used.

The electrophotographic photosensitive member was also surface-processed in the same way as that in Example 1 except that, in the profile-providing material used in Example 1, the major-axis diameter shown by D in FIG. 8A was 4.5 μm, the interval shown by E between projections each was 0.5 μm and the height shown by F of each projection was 9.0 μm.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 5

An electrophotographic photosensitive member was produced and its surface was processed both in the same way as that in Example 4 except that, in producing the electrophotographic photosensitive member in Example 4, the silicon-containing compound to be added to the surface layer was changed for a siloxane-modified polyester (1) having structural units shown in Table 1.

Here, as a method of synthesizing the siloxane-modified polyester (1), it was synthesized by the method according to Synthesis Example 3 given previously. As siloxane compounds used in synthesizing the siloxane-modified polyester (1), 4 g of the siloxane compound represented by Formula (4-1) (m=40) and 8 g of the siloxane compound represented by Formula (5-1) (n=40) were used.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 6

An electrophotographic photosensitive member was produced and its surface was processed both in the same way as that in Example 4 except that, in producing the electrophotographic photosensitive member in Example 4, the silicon-containing compound to be added to the surface layer was changed for a siloxane-modified polycarbonate (6) having structural units shown in Table 1 and was added in an amount changed to 0.02 part.

Here, as a method of synthesizing the siloxane-modified polycarbonate (6), it was synthesized by the method according to Synthesis Example 2 given previously. As siloxane compounds used in this synthesis, the siloxane compound represented by Formula (4-1) (m=60) and the siloxane compound represented by Formula (5-1) (n=70) were used.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 7

An electrophotographic photosensitive member was produced and its surface was processed both in the same way as that in Example 4 except that, in producing the electrophotographic photosensitive member in Example 4, the silicon-containing compound to be added to the surface layer was changed for a siloxane-modified polycarbonate (5) having structural units shown in Table 1 and was added in an amount changed to 0.49 part.

Here, as a method of synthesizing the siloxane-modified polycarbonate (5), it was synthesized by the method according to Synthesis Example 2 given previously. As siloxane compounds used in this synthesis, the siloxane compound represented by Formula (4-1) (m=60) and the siloxane compound represented by Formula (5-1) (n=60) were used.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 8

An electrophotographic photosensitive member was produced and its surface was processed both in the same way as that in Example 4 except that, in producing the electrophotographic photosensitive member in Example 4, the silicon-containing compound to be added to the surface layer was changed for a siloxane-modified polycarbonate (4) having structural units shown in Table 1 and was added in an amount changed to 0.3 part.

Here, as a method of synthesizing the siloxane-modified polycarbonate (4), it was synthesized by the method according to Synthesis Example 2 given previously. As siloxane compounds used in this synthesis, the siloxane compound represented by Formula (4-1) (m=20) and the siloxane compound represented by Formula (5-1) (n=20) were used.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 9

An electrophotographic photosensitive member was produced in the same way as that in Example 3, and its surface was processed in the same way as that in Example 1 except that, in the profile-providing material used in Example 1, the major-axis diameter shown by D in FIG. 8A was 1.9 μm, the interval shown by E between projections each was 0.6 μm and the height shown by F of each projection was 1.2 μm.

The surface profile was measured in the same way as that in Example 1 to ascertain that columnar depressions stood formed on the surface of the electrophotographic photosensitive member. Also, the depressions stood formed at intervals of 0.6 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 1,600 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 10

The procedure of Example 4 was repeated to form on the support the conductive layer, the intermediate layer and the charge generation layer.

Next, a charge transport layer coating solution was prepared in the same way as that in Example 4 except that the solvent used in forming the charge transport layer was changed for a mixed solvent of 350 parts of chlorobenzene and 35 parts of dimethoxymethane. The charge transport layer coating solution thus prepared was coated on the charge generation layer by dipping so that the conductive layer, the intermediate layer, the charge generation layer and the charge transport layer were formed in this order on the support and that the charge transport layer was a surface layer.

On lapse of 60 seconds after the coating step was completed, the base member having been coated with the charge transport layer coating solution (surface layer coating solution) was retained for 120 seconds in a condensation-step unit the interior of which was previously conditioned at a relative humidity of 70% and an atmospheric temperature of 60° C. On lapse of 60 seconds after the condensation step was completed, this base member with the charge transport layer was put into an air blow dryer the interior of which was previously heated to 120° C., to carry out a drying step for 60 minutes. Thus, an electrophotographic photosensitive member was produced the charge transport layer of which was a surface layer, having a layer thickness (average layer thickness) of 20 μm at the position of 130 mm from the support upper end.

The surface profile was measured in the same way as that in Example 1 to ascertain that depressions stood formed on the surface of the electrophotographic photosensitive member. Also, the depressions stood formed at intervals of 1.8 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 278 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

As the electrophotographic photosensitive member for ESCA measurement, an electrophotographic photosensitive member having a charge transport layer with a layer thickness (average layer thickness) of 20 μm and not having any depressions on the surface was used which was obtained, in the production process of the above electrophotographic photosensitive member, by coating the base member with the surface layer charge transport layer coating solution and immediately thereafter carrying out the drying step for 60 minutes.

Example 11

An electrophotographic photosensitive member was produced in the same way as that in Example 4. On the surface of the electrophotographic photosensitive member obtained, depressions were formed by using a KrF excimer laser (wavelength λ: 248 nm) shown in FIG. 3B. Here, a mask made of quartz glass was used which had a pattern in which circular laser light transmitting areas of 8.0 μm in diameter as shown in FIG. 3A were arranged at intervals of 2.0 μm as shown in the drawing. Irradiation energy was set at 0.9 J/cm$^3$. In FIG. 3A, letter symbol a denotes a laser light screening area. Further, irradiation was made in an area of 2 mm square per irradiation made once, and the surface was irradiated with the laser light three times per irradiation portion of 2 mm square. The depressions were likewise formed by a method in which, as shown in FIG. 3B, the electrophotographic photosensitive member was rotated and the irradiation position was shifted in its axial direction, to form the depressions on the surface of the electrophotographic photosensitive member.

The surface profile was measured in the same way as that in Example 1 to ascertain that depressions shown in FIG. 3C stood formed on the surface of the electrophotographic photosensitive member. Also, the depressions stood formed at intervals of 2.0 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 100 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 12

An electrophotographic photosensitive member was produced, the surface of the electrophotographic photosensitive member was processed and performance evaluation was made all in the same way as that in Example 4 except that, in the performance evaluation on rubbing memory in Example 4, the touch pressure of the elastic cleaning blade against the electrophotographic photosensitive member and the touch angle between the elastic cleaning blade and the electrophotographic photosensitive member in the process cartridge used were set at 30 N/m and 25°, respectively.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 13

An electrophotographic photosensitive member was produced, the surface of the electrophotographic photosensitive member was processed and performance evaluation was made all in the same way as that in Example 4 except that, in the performance evaluation on rubbing memory in Example 4, the touch pressure of the elastic cleaning blade against the electrophotographic photosensitive member and the touch angle between the elastic cleaning blade and the electrophotographic photosensitive member in the process cartridge used were set at 120 N/m and 30°, respectively.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Example 14

The procedure of Example 4 was repeated to form on the support the conductive layer, the intermediate layer and the charge generation layer.

Next, a charge transport layer coating solution was prepared in the same way as that in Example 4 except that the solvent used in forming the charge transport layer was changed for a mixed solvent of 300 parts of chlorobenzene, 150 parts of oxosilane and 50 parts of dimethoxymethane. The charge transport layer coating solution thus prepared was coated on the charge generation layer by dipping so that the conductive layer, the intermediate layer, the charge generation layer and the charge transport layer were formed in this order on the support and that the charge transport layer was a surface layer.

On lapse of 60 seconds after the coating step was completed, the base member having been coated with the charge transport layer coating solution (surface layer coating solution) was retained for 120 seconds in a condensation-step unit the interior of which was previously conditioned at a relative humidity of 80% and an atmospheric temperature of 50° C. On lapse of 60 seconds after the condensation step was completed, this base member with the charge transport layer was put into an air blow dryer the interior of which was previously heated to 120° C., to carry out a drying step for 60 minutes. Thus, an electrophotographic photosensitive member was produced the charge transport layer of which was a surface layer, having a layer thickness (average layer thickness) of 20 μm at the position of 130 mm from the support upper end.

The surface profile was measured in the same way as that in Example 1 to ascertain that depressions stood formed on the surface of the electrophotographic photosensitive member. An image of depressions observed on a laser electron microscope, on the surface of the photosensitive member produced in this Example is shown in FIG. 10. Also, the depressions stood formed at intervals of 0.2 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

As the electrophotographic photosensitive member for ESCA measurement, an electrophotographic photosensitive member having a charge transport layer with a layer thickness (average layer thickness) of 20 μm and not having any depressions on the surface of the charge transport layer was used which was obtained, in the production process of the above electrophotographic photosensitive member, by coating the base member with the surface layer charge transport layer coating solution and immediately thereafter carrying out the drying step for 60 minutes.

Example 15

The procedure of Example 4 was repeated to form on the support the conductive layer, the intermediate layer and the charge generation layer.

Next, a charge transport layer coating solution was prepared in the same way as that in Example 4 except that the solvent used in forming the charge transport layer was changed for a mixed solvent of 300 parts of chlorobenzene, 140 parts of dimethoxymethane and 10 parts of (methylsulfinyl)methane. The charge transport layer coating solution thus prepared was coated on the charge generation layer by dipping so that the conductive layer, the intermediate layer, the charge generation layer and the charge transport layer were formed in this order on the support and that the charge transport layer was a surface layer.

On lapse of 60 seconds after the coating step was completed, the base member having been coated with the charge transport layer coating solution (surface layer coating solution) was retained for 180 seconds in a condensation-step unit the interior of which was previously conditioned at a relative humidity of 70% and an atmospheric temperature of 45° C. On lapse of 60 seconds after the condensation step was completed, this base member with the charge transport layer was put into an air blow dryer the interior of which was previously heated to 120° C., to carry out a drying step for 60 minutes. Thus, an electrophotographic photosensitive member was produced the charge transport layer of which was a surface layer, having a layer thickness (average layer thickness) of 20 μm at the position of 130 mm from the support upper end.

The surface profile was measured in the same way as that in Example 1 to ascertain that depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 2,500 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

As the electrophotographic photosensitive member for ESCA measurement, an electrophotographic photosensitive member having a charge transport layer with a layer thickness (average layer thickness) of 20 μm and not having any depressions on the surface of the charge transport layer was used which was obtained, in the production process of the above electrophotographic photosensitive member, by coating the base member with the surface layer charge transport layer coating solution and immediately thereafter carrying out the drying step for 60 minutes.

Comparative Example 1

An electrophotographic photosensitive member was produced in the same way as that in Example 1, and its surface was processed in the same way as that in Example 1 except that the surface processing of the electrophotographic photosensitive member by means of the profile-providing material used in Example 1 was not carried out. The surface profile of the electrophotographic photosensitive member was measured in the same way as that in Example 1. Since any processing for surface profile was not carried out, there was not any clear periodic unevenness and a surface layer was obtained which was substantially flat and had a layer thickness of 20 μm.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Comparative Example 2

An electrophotographic photosensitive member was produced in the same way as that in Example 1, and its surface was processed in the same way as that in Example 1 except that, in the profile-providing material used in Example 1, the major-axis diameter shown by D in FIG. 8A was 4.2 μm, the interval shown by E between projections each was 0.8 μm and the height shown by F of each projection was 1.1 μm.

The surface profile of the electrophotographic photosensitive member was measured in the same way as that in Example 1 to ascertain that columnar depressions stood formed on its surface and the depressions stood formed at intervals of 0.8 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was also counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Comparative Example 3

An electrophotographic photosensitive member was produced in the same way as that in Example 1 except that, in producing the electrophotographic photosensitive member in Example 1, the silicon-containing compound to be added to the surface layer was changed for a phenol-modified silicone oil (trade name: X-22-1821; available from Shin-Etsu Silicone Co., Ltd.). The electrophotographic photosensitive member was surface-processed in the same way as that in Example 1.

The surface profile was measured in the same way as that in Example 1 to ascertain that columnar depressions stood formed on the surface of the electrophotographic photosensitive member, but the silicone oil was seen to have agglomerated here and there in the depressions. The interval I of the depressions was 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was also counted to find that there were 1,600 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Comparative Example 4

An electrophotographic photosensitive member was produced in the same way as that in Example 1 except that, in producing the electrophotographic photosensitive member in Example 1, the silicon-containing compound to be added to the surface layer was changed for a siloxane-modified polycarbonate (7) having structural units shown in Table 1 and having the siloxane structure only in the backbone chain, and was added in an amount changed to 0.6 part.

Here, as a method of synthesizing the siloxane-modified polycarbonate (7), it was synthesized by the method according to Synthesis Example 1 given previously. As a siloxane compound used in this synthesis, 30 g of the siloxane compound represented by Formula (4-3) (m=10) only was used.

The electrophotographic photosensitive member was surface-processed in the same way as that in Example 1 except that, in the profile-providing material used in Example 1, the major-axis diameter shown by D in FIG. 8A was 4.2 μm, the interval shown by E between projections each was 0.8 μm and the height shown by F of each projection was 2.0 μm.

The surface profile of the electrophotographic photosensitive member was measured in the same way as that in Example 1 to ascertain that columnar depressions stood formed on its surface and the depressions stood formed at intervals of 0.8 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was also counted to find that there were 400 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Comparative Example 5

An electrophotographic photosensitive member was produced in the same way as that in Example 1 except that, in producing the electrophotographic photosensitive member in Example 1, any silicon-containing compound was not added to the surface layer. The electrophotographic photosensitive member was surface-processed in the same way as that in Example 1 except that, in the profile-providing material used in Example 1, the major-axis diameter shown by D in FIG. 8A was 2.0 μm, the interval shown by E between projections each was 0.5 μm and the height shown by F of each projection was 2.4 μm.

The surface profile of the electrophotographic photosensitive member was measured in the same way as that in Example 1 to ascertain that columnar depressions stood formed on its surface. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was also counted to find that there were 1,600 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

Comparative Example 6

An electrophotographic photosensitive member was produced in the same way as that in Example 1 except that, in producing the electrophotographic photosensitive member in Example 1, the silicon-containing compound to be added to the surface layer, i.e., the siloxane-modified polycarbonate (1) having structural units shown in Table 1 and having the siloxane structure only in the backbone chain, was added in an amount changed to 0.02 part. Then, the electrophotographic photosensitive member was surface-processed in the same way as that in Example 1.

The surface profile was measured in the same way as that in Example 1 to ascertain that columnar depressions stood formed on the surface of the electrophotographic photosensitive member. Also, the depressions stood formed at intervals of 0.5 μm. The number of depressions in unit area (100 μm×100 μm) which had the depth (Rdv) of 0.1 μm or more to 10.0 μm or less and the ratio of depth to major-axis diameter, Rdv/Rpc, of from more than 0.3 to 7.0 or less was counted to find that there were 1,600 depressions.

The values of Rpc-A, Rdv-A and Rdv-A/Rpc-A measured and the ESCA data obtained by measurement of depressions without surface processing for the depressions are shown in Table 2. Performance evaluation of the electrophotographic photosensitive member was also made in the same way as that in Example 1. The results are shown in Table 2.

TABLE 1

| | Siloxane compound 1 | | Siloxane compound 2 | | | | |
|---|---|---|---|---|---|---|---|
| | No. | m | No. | n | Bisphenol | Viscosity average molecular weight (Mv) | Siloxane moiety in silicon-containing compound (by mass) |
| Siloxane-modified polycarbonate (1) | (4-1) | 15 | — | — | (2-13) | 42,000 | 20% |
| Siloxane-modified polycarbonate (2) | (4-1) | 40 | — | — | (2-13) | 28,000 | 30% |
| Siloxane-modified polycarbonate (3) | (4-1) | 40 | (5-1) | 40 | (2-13) | 20,600 | 40% |
| Siloxane-modified polycarbonate (4) | (4-1) | 20 | (5-1) | 20 | (2-13) | 26,000 | 20% |
| Siloxane-modified polycarbonate (5) | (4-1) | 60 | (5-1) | 60 | (2-13) | 15,000 | 60% |
| Siloxane-modified polycarbonate (6) | (4-1) | 60 | (5-1) | 70 | (2-13) | 16,100 | 65% |
| Siloxane-modified polycarbonate (7) | (4-3) | 10 | — | — | (2-13) | 45,000 | 20% |
| Siloxane-modified polyester (1) | (4-1) | 40 | (5-1) | 40 | (2-2) | 22,000 | 40% |

TABLE 2

| | Rpc-A | Rdv-A | Rdv-A/ Rpc-A | Amount of silicon = containing compound, based on whole solid content (by mass) | Siloxane moiety in silicon = containing compound, based on whole solid content (by mass) | ESCA measurement: Presence propn of silicon element in surface layer const. elements | A/B ratio | Rubbing memory images (after 5 min. leaving) | Rubbing memory images (after 2 hr. leaving) | Positive charge (V) | Positive charge attenuation percentage (%) |
|---|---|---|---|---|---|---|---|---|---|---|---|
| Example: | | | | | | | | | | | |
| 1 | 2.0 | 1.8 | 0.9 | 0.54% | 0.10% | 2.5% | 0.28 | B | B | 50 | 26% |
| 2 | 2.0 | 1.8 | 0.9 | 0.11% | 0.02% | 0.8% | 0.25 | C | C | 50 | 18% |
| 3 | 2.0 | 1.8 | 0.9 | 0.20% | 0.05% | 3.6% | 0.16 | B | B | 50 | 23% |
| 4 | 4.5 | 5.0 | 1.1 | 0.33% | 0.13% | 12.2% | 0.02 | A | A | 25 | 42% |
| 5 | 4.5 | 5.0 | 1.1 | 0.33% | 0.13% | 11.5% | 0.02 | A | A | 28 | 40% |
| 6 | 4.5 | 5.0 | 1.1 | 0.02% | 0.01% | 7.1% | 0.01 | B | B | 50 | 23% |
| 7 | 4.5 | 5.0 | 1.1 | 0.54% | 0.32% | 15.1% | 0.02 | A | A | 33 | 36% |

TABLE 2-continued

| | Rpc-A | Rdv-A | Rdv-A/ Rpc-A | Amount of silicon = containing compound, based on whole solid content (by mass) | Siloxane moiety in silicon = containing compound, based on whole solid content (by mass) | ESCA measurement Presence propn of silicon element in surface layer const. elements | A/B ratio | Rubbing memory images (after 5 min. leaving) | Rubbing memory images (after 2 hr. leaving) | Positive charge (V) | Positive charge attenuation percentage (%) |
|---|---|---|---|---|---|---|---|---|---|---|---|
| 8 | 4.5 | 5.0 | 1.1 | 0.33% | 0.07% | 14.2% | 0.03 | B | B | 45 | 31% |
| 9 | 1.9 | 0.6 | 0.3 | 0.20% | 0.05% | 3.8% | 0.16 | C | B | 50 | 23% |
| 10 | 4.2 | 6.0 | 1.4 | 0.33% | 0.13% | 12.2% | 0.02 | A | B | 29 | 38% |
| 11 | 8.0 | 3.2 | 2.5 | 0.33% | 0.13% | 12.2% | 0.02 | A | B | 38 | 35% |
| 12 | 4.5 | 5.0 | 1.1 | 0.13% | 0.13% | 12.2% | 0.02 | A | A | 21 | 37% |
| 13 | 4.5 | 5.0 | 1.1 | 0.13% | 0.13% | 12.2% | 0.02 | B | A | 50 | 38% |
| 14 | 4.6 | 8.5 | 1.8 | 0.13% | 0.13% | 12.2% | 0.02 | A | B | 30 | 35% |
| 15 | 1.5 | 2.3 | 1.5 | 0.13% | 0.13% | 12.2% | 0.02 | A | A | 24 | 41% |
| Comparative Example: | | | | | | | | | | | |
| 1 | 0.014 | 0.010 | 0.7 | 0.54% | 0.10% | 2.5% | 0.28 | D | D | 50 | 10% |
| 2 | 4.2 | 0.7 | 0.2 | 0.54% | 0.10% | 2.5% | 0.28 | D | C | 50 | 14% |
| 3 | 2.0 | 1.8 | 0.9 | 0.54% | 0.10% | 0.5% | 0.40 | D | C | 50 | 9% |
| 4 | 4.2 | 1.7 | 0.4 | 0.66% | 0.13% | 1.7% | 0.38 | D | C | 50 | 13% |
| 5 | 2.0 | 1.2 | 0.6 | 0.00% | 0.00% | 0.0% | — | E | D | 50 | 7% |
| 6 | 2.0 | 1.8 | 0.9 | 0.02% | 0.004% | 0.40% | 0.42 | D | C | 50 | 13% |

From the results shown above, it is seen in comparison of Examples 1 to 15 of the present invention with Comparative Examples 1 to 6 that the rubbing memory can be prevented in virtue of the features that the surface layer of the electrophotographic photosensitive member contains the silicon-containing compound of the present invention in the prescribed amount and also the electrophotographic photosensitive member has on its surface the depressions the ratio of depth to major-axis diameter, Rdv/Rpc, of which is from more than 0.3 to 7.0 or less. From the results of attenuation percentage of positive charge, it is also seen that the electrophotographic photosensitive member of the present invention has enabled effective decrease of positive electric charges having been generated by friction.

This application claims the benefit of Japanese Patent Application No. 2008-248210, filed Sep. 26, 2008, which is hereby incorporated by reference herein in its entirety.

The invention claimed is:

1. An electrophotographic photosensitive member which comprises a support and a photosensitive layer provided on the support, wherein;

a surface layer of the electrophotographic photosensitive member contains a silicon-containing compound in an amount of less than 0.6% by mass based on the whole solid content in the surface layer;

the silicon-containing compound in the surface layer has a siloxane moiety in an amount of 0.01% by mass or more, based on the whole solid content in the surface layer;

on the surface of the electrophotographic photosensitive member, depressions which are independent from one another are formed in a number of from 50 or more to 70,000 or less per unit area (100 μm ×100 μm), and the depressions are depressions each having a ratio of depth (Rdv) to major-axis diameter (Rpc), Rdv/Rpc, of from more than 0.3 to 7.0 or less and having a depth (Rdv) of from 0.1 μm or more to 10.0 μm or less;

the surface layer has, at the outermost surface thereof, a silicon element in a presence proportion of 0.6% by mass or more, based on constituent elements thereat, as measured by X-ray photoelectron spectroscopy (ESCA); and the presence proportion [A (% by mass)] of the silicon element to the constituent elements in the surface layer at an inner part of 0.2 μm from the outermost surface thereof and the presence proportion [B (% by mass)] of the silicon element to the constituent elements at the outermost surface thereof as measured by X-ray photoelectron spectroscopy (ESCA) are in a ratio (A/B) of from more than 0.0 to less than 0.3; and the silicon-containing compound is a polymer having a structure represented by the following Formula (1) and a repeating structural unit represented by the following Formula (2) or the following Formula (3):

(1)

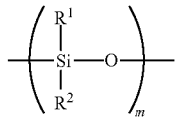

wherein $R^1$ and $R^2$ each independently represent a hydrogen atom, a halogen atom, an alkoxyl group, a nitro group, a substituted or unsubstituted alkyl group or a substituted or unsubstituted aryl group; and m represents an average value of the number of repeating structural units each shown in parentheses, and is in the range of from 1 to 500; and (2)

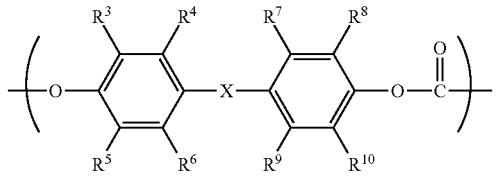

wherein X represents a single bond, —O—, —S— or a substituted or unsubstituted alkylidene group; and $R^3$ to $R^{10}$ each independently represent a hydrogen atom, a halogen atom, an alkoxyl group, a nitro group, a substituted or unsubstituted alkyl group or a substituted or unsubstituted aryl group; or (3)

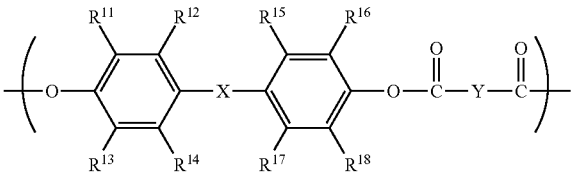

wherein X and Y each represent a single bond, —O—, —S— or a substituted or unsubstituted alkylidene group; and $R^{11}$ to $R^{18}$ each independently represent a hydrogen atom, a halogen atom, an alkoxyl group, a nitro group, a substituted or unsubstituted alkyl group or a substituted or unsubstituted aryl group.

2. The electrophotographic photosensitive member according to claim 1, wherein the surface layer contains the silicon-containing compound in an amount of not more than 0.54% by mass based on the whole solid content in the surface layer and the silicon-containing compound in the surface layer has the siloxane moiety in an amount of 0.05% by mass or more, based on the whole solid content in the surface layer.

3. The electrophotographic photosensitive member according to claim 1, wherein the silicon-containing compound has the siloxane moiety in an amount of from 30.0% by mass or more to 60.0% by mass or less, based on the total mass of the silicon-containing compound, and the number of repeating structural unit represented by Formula (2) or Formula (3) the silicon-containing compound has is in an average value of from 20 or more to 60 or less.

4. The electrophotographic photosensitive member according to claim 1, wherein the silicon-containing compound has, as structure at the part of at least one terminal, a structure represented by the following Formula (4):

(4)

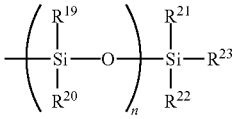

wherein $R^{19}$ to $R^{23}$ each independently represent a hydrogen atom, a halogen atom, an alkoxyl group, a nitro group, a substituted or unsubstituted alkyl group or a substituted or unsubstituted aryl group; and n represents an average value of the number of repeating structural units each shown in parentheses, and is in the range of from 1 to 500.

5. A process cartridge which comprises the electrophotographic photosensitive member according to claim 1 and supported integrally therewith a cleaning means, and is detachably mountable to the main body of an electrophotographic apparatus;

the cleaning means comprising a cleaning blade which is provided in touch with, and in the direction counter to, the surface of the electrophotographic photosensitive member.

6. The process cartridge according to claim 5, wherein the cleaning blade is not coated with any lubricant.

7. The process cartridge according to claim 5, wherein the electrophotographic photosensitive member and the cleaning blade are set at a touch linear pressure of from 30 N/m or more to 120 N/m or less where the force applied per unit length in the touch lengthwise direction between them is termed as touch linear pressure.

8. The process cartridge according to claim 5, wherein the cleaning blade is set at a touch angle of from 25° or more to 30° or less against the electrophotographic photosensitive member.

9. An electrophotographic apparatus which comprises the electrophotographic photosensitive member according to claim 1, a charging means, an exposure means, a developing means, a transfer means and a cleaning means;

the cleaning means comprising a cleaning blade which is provided in touch with, and in the direction counter to, the surface of the electrophotographic photosensitive member.

* * * * *